US007749667B2

(12) United States Patent
Kawahara et al.

(10) Patent No.: US 7,749,667 B2
(45) Date of Patent: Jul. 6, 2010

(54) IMAGE FORMING METHOD, AND ELECTROPHOTOGRAPHIC APPARATUS MAKING USE OF THE IMAGE FORMING METHOD

(75) Inventors: Masataka Kawahara, Mishima (JP); Hiroki Uematsu, Suntoh-gun (JP); Akio Maruyama, Tokyo (JP); Harunobu Ogaki, Suntoh-gun (JP); Atsushi Ochi, Numazu (JP); Akira Shimada, Suntoh-gun (JP); Kyoichi Teramoto, Abiko (JP); Toshihiro Kikuchi, Yokohama (JP); Akio Koganei, Ichikawa (JP); Takayuki Sumida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/769,957

(22) Filed: Jun. 28, 2007

(65) Prior Publication Data

US 2007/0254232 A1 Nov. 1, 2007

Related U.S. Application Data

(63) Continuation of application No. PCT/JP2007/051859, filed on Jan. 30, 2007.

(30) Foreign Application Priority Data

| | | | |
|---|---|---|---|
| Jan. 31, 2006 | (JP) | ..... | 2006-022896 |
| Jan. 31, 2006 | (JP) | ..... | 2006-022898 |
| Jan. 31, 2006 | (JP) | ..... | 2006-022899 |
| Jan. 31, 2006 | (JP) | ..... | 2006-022900 |
| Jan. 26, 2007 | (JP) | ..... | 2007-016219 |

(51) Int. Cl.
*G03G 13/08* (2006.01)

(52) U.S. Cl. ..... 430/46.1; 430/47.1; 430/66; 430/123.4; 399/159

(58) Field of Classification Search ..... 430/46.1, 430/47.1, 66; 399/159
See application file for complete search history.

(56) References Cited

U.S. PATENT DOCUMENTS 4,985,330 A 1/1991 Tsuchiya et al. ..... 430/130

(Continued)

FOREIGN PATENT DOCUMENTS

JP 52-026226 2/1977

(Continued)

OTHER PUBLICATIONS

English translation of JP 2005-345647 published Dec. 2005.*

(Continued)

*Primary Examiner*—Mark F Huff
*Assistant Examiner*—Peter L Vajda
(74) *Attorney, Agent, or Firm*—Fitzpatrick, Cella, Harper & Scinto

(57) ABSTRACT

An image forming method is disclosed having a charging step, an exposure step, a developing step and a transfer step. This method uses a toner which includes toner particles containing a binder resin and a colorant, and inorganic fine powder, and uses a photosensitive member which has on its surface depressed portions which are independent of one another. The depressed portions have openings having an average minor-axis diameter Lpc satisfying the relationship of Dg<Lpc<Dt (Dt represents the weight-average particle diameter of the toner, and Dg represents the maximum number-average particle diameter among number-average particle diameter(s) of one or two or more types of inorganic fine powder constituting the inorganic fine powder, and the toner has an average circularity of from 0.925 to 0.995.

13 Claims, 21 Drawing Sheets

U.S. PATENT DOCUMENTS

| | | | | |
|---|---|---|---|---|
| 5,114,814 | A | 5/1992 | Sakoh et al. | 430/46 |
| 5,411,827 | A | 5/1995 | Tamura et al. | 430/58 |
| 5,427,880 | A | 6/1995 | Tamura et al. | 430/59 |
| 5,496,671 | A | 3/1996 | Tamura et al. | 430/58 |
| 6,096,468 | A * | 8/2000 | Ohno et al. | 430/108.3 |
| 6,180,303 | B1 | 1/2001 | Uematsu et al. | 430/59.6 |
| 6,806,009 | B2 | 10/2004 | Tanaka et al. | 430/66 |
| 6,987,943 | B2 | 1/2006 | Ito | 399/350 |
| 7,186,489 | B2 | 3/2007 | Uematsu et al. | 430/66 |
| 7,226,711 | B2 | 6/2007 | Amamiya et al. | 430/58.7 |
| 2003/0194625 | A1 * | 10/2003 | Tanaka et al. | 430/58.8 |
| 2005/0163544 | A1 | 7/2005 | Ito | 399/350 |
| 2005/0255393 | A1 * | 11/2005 | Nakata et al. | 430/56 |

FOREIGN PATENT DOCUMENTS

| | | |
|---|---|---|
| JP | 53-092133 | 8/1978 |
| JP | 57-094772 | 6/1982 |
| JP | 01-099060 | 4/1989 |
| JP | 02-127652 | 5/1990 |
| JP | 02-139566 | 5/1990 |
| JP | 02-150850 | 6/1990 |
| JP | 05-216249 | 8/1993 |
| JP | 07-072640 | 3/1995 |
| JP | 2000-066424 | 3/2000 |
| JP | 2000-066425 | 3/2000 |
| JP | 2001-013732 | 1/2001 |
| JP | 2001-066814 | 3/2001 |
| JP | 2003-280474 | 10/2003 |
| JP | 2005-345647 | * 12/2005 |
| JP | 2006-018206 | 1/2006 |
| KR | 2003-0053034 | 6/2003 |
| WO | WO 2005/093518 A1 | 10/2005 |

OTHER PUBLICATIONS

English translation of abstract of JP 2005-345647 published Dec. 2005.*

Korea Office Action dated Oct. 23, 2009 counterpart application No. 10-2008-7021312 (5 pages).

* cited by examiner

IMAGE FORMING METHOD, AND ELECTROPHOTOGRAPHIC APPARATUS MAKING USE OF THE IMAGE FORMING METHOD

This application is a continuation of International Application No. PCT/JP2007/051859 filed on Jan. 30, 2007, which claims the benefit of Japanese Patent Application No. 2006-022899 filed on Jan. 31, 2006, Japanese Patent Application No. 2006-022898 filed on Jan. 31, 2006, Japanese Patent Application No. 2006-022896 filed on Jan. 31, 2006, Japanese Patent Application No. 2006-022900 filed on Jan. 31, 2006 and Japanese Patent Application No. 2007-016219 filed on Jan. 26, 2007.

BACKGROUND OF THE INVENTION

1. Field of the Invention

This invention relates to an image forming method and an electrophotographic apparatus using the image forming method.

2. Description of the Related Art

As an electrophotographic photosensitive member, in view of advantages of low prices and high productivity, an organic electrophotographic photosensitive member has become popular, which has a support and a photosensitive layer (organic photosensitive layer) provided thereon using an organic material as a photoconductive material (such as a charge generating material and a charge transporting material). As the organic electrophotographic photosensitive member, in view of advantages such as a high sensitivity and a possibility of designing various materials, an electrophotographic photosensitive member is prevalent which has a multi-layer type photosensitive layer including a charge generation layer containing a charge generating material such as a photoconductive dye or a photoconductive pigment, and a charge transport layer containing a charge transporting material such as a photoconductive polymer or a photoconductive low-molecular weight compound, with the layers being superposed one on the other.

To the surface of the electrophotographic photosensitive member, electrical external force and/or mechanical external force is/are applied during charging, exposure, development, transfer and cleaning, and hence the electrophotographic photosensitive member is also required to have durability to such external force. Specifically, the photosensitive member is required to have durability to scratching and wear of its surface due to such external force, i.e., scratch resistance and wear resistance.

As for a technique for improving the scratch resistance and wear resistance of the surface of the electrophotographic photosensitive member, an electrophotographic photosensitive member is disclosed which has as a surface layer a cured layer using a curable resin for a binder resin (see Japanese Patent Application Laid-Open No. H02-127652).

An electrophotographic photosensitive member is also disclosed which has as a surface layer a charge transporting cured layer formed by curing-polymerizing a monomer having a carbon-carbon double bond and a charge transporting monomer having a carbon-carbon double bond by heat or light energy (see Japanese Patent Applications Laid-open No. H05-216249 and No. H07-072640).

An electrophotographic photosensitive member is further disclosed which has as a surface layer a charge transporting cured layer formed by cure-polymerizing a hole transporting compound having a chain-polymerizable functional group in the same molecule by energy of electron rays (see Japanese Patent Applications Laid-Open No. 2000-066424 and No. 2000-066425).

Thus, in recent years, as a technique by which the scratch resistance and wear resistance of the peripheral surfaces of organic electrophotographic photosensitive members are improved, a technique has been established in which the surface layers of electrophotographic photosensitive members are composed of cured layers so as to improve the mechanical strength of the surface layers.

The electrophotographic photosensitive member is commonly used in an electrophotographic image forming process having, as mentioned above, a charging step, an exposure step, a developing step, a transfer step and a cleaning step. In the electrophotographic image forming process, the cleaning step of removing transfer residual toner remaining on the electrophotographic photosensitive member after the transfer step to clean the peripheral surface of the electrophotographic photosensitive member, is important in order to obtain sharp images.

As a cleaning method, in view of advantages such as low costs and easiness of designing, a method is prevalent in which a cleaning blade is brought into contact with the electrophotographic photosensitive member surface to delete the gap between the cleaning blade and the electrophotographic photosensitive member so that a toner can be prevented from escaping to thereby scrape the transfer residual toner off.

However, in the cleaning method using a cleaning blade, the frictional force between the cleaning blade and the electrophotographic photosensitive member is so large that chattering and turn-up of the cleaning blade are liable to occur and the blade edge tends to be gouged or chipped off to cause faulty cleaning. The chattering of the cleaning blade is a phenomenon in which the frictional resistance between the cleaning blade and the peripheral surface of the electrophotographic photosensitive member becomes high and vibrates the cleaning blade. The turn-up of the cleaning blade is a phenomenon in which the cleaning blade becomes reversed in the direction of surface movement of the electrophotographic photosensitive member.

These problems concerning the cleaning blade become more remarkable as the surface layer of the electrophotographic photosensitive member has higher mechanical strength, i.e., as the peripheral surface of the electrophotographic photosensitive member is more difficult to abrade.

In addition, the surface layer of the organic electrophotographic photosensitive member is commonly often formed by dip coating, and the surface of a surface layer formed by dip coating is so smooth that the cleaning blade and the peripheral surface of the electrophotographic photosensitive member come into contact with each other in a larger area and the frictional resistance between the cleaning blade and the peripheral surface of the electrophotographic photosensitive member increases. Thus, the above problems become remarkable.

As one of methods for overcoming the chattering and turn-up of the cleaning blade, a method is known in which the surface of the electrophotographic photosensitive member is appropriately roughened. As techniques for roughening the surface of the electrophotographic photosensitive member, the following are disclosed, for example.

A technique in which the surface roughness (roughness of peripheral surface) of the electrophotographic photosensitive member is controlled within a specific range in order to make transfer materials readily separable from the surface of the electrophotographic photosensitive member, and a method in which drying conditions for forming a surface layer are controlled to roughen the surface of the electrophotographic photosensitive member in an orange peel state (see Japanese Patent Application Laid-open No. S53-092133); a technique in which the surface layer is incorporated with particles to roughen the surface of the electrophotographic photosensitive member (see Japanese Patent Application Laid-open No. S52-026226); a technique in which the surface of a surface layer is polished with a wire brush made of a metal, to roughen the surface of the electrophotographic photosensitive member (see Japanese Patent Application Laid-open No. S57-094772); a technique in which the surface of the organic electrophotographic photosensitive member is roughened in order to solve turn-up of the cleaning blade and chipping of the edge portion which are problems occurring in the case where a specific cleaning means and toner are used in an electrophotographic apparatus whose process speed is higher than a specific process speed (see Japanese Patent Application Laid-open No. H01-099060; a technique in which the surface of a surface layer is polished with a filmy abrasive to roughen the surface of the electrophotographic photosensitive member (see Japanese Patent Application Laid-open No. H02-139566); and a technique in which blasting is carried out to roughen the peripheral surface of the electrophotographic photosensitive member (see Japanese Patent Application Laid-open No. H02-150850).

However, these have no specific disclosure as to details of surface profiles of the electrophotographic photosensitive members thus surface-roughened.

From the viewpoint of roughening surface layers appropriately, the roughening of surfaces by the above conventional techniques can be seen to bring about certain effects in reducing frictional force with the cleaning blade. However, a further improvement is being sought. A further improvement is being sought in order to solve the problems on how to control cleaning performance and prevent toner adhesion from a microscopic viewpoint, in the respect that the surface profile is streaky or is in indefinite form or has unevenness with a difference in size.

Based on detailed analyses and studies made taking note of the controlling of a surface profile of the electrophotographic photosensitive member, an electrophotographic photosensitive member having certain dimples has been proposed (see Japanese Patent Application Laid-open No. 2001-066814). This method has hit a directionality in which the problems such as cleaning performance and electrostatic memory of electrophotographic photosensitive member caused by rubbing may be solved, but a further improvement in performance is being sought.

A technique is also disclosed in which the surface of the electrophotographic photosensitive member is processed by compression forming by means of a stamper having unevenness in the form of wells (see WO2005-093518). As compared with the techniques disclosed in the above patent documents, this technique is considered to be more effective in solving the above problems in the respect that an unevenness profile with independent shapes can be formed on the electrophotographic photosensitive member surface with good controllability. According to this method, it has been reported that an unevenness profile in the form of wells each having a length or pitch of from 10 to 3,000 nm is formed on the surface of the electrophotographic photosensitive member, and releasability of toner is improved and nip pressure of the cleaning blade can be reduced, consequently enabling abrasion of the photosensitive member to be reduced.

However, in the image forming method in which the nip pressure of the cleaning blade has been thus reduced, faulty cleaning tends to occur in an environment of low temperature and low humidity. In addition, in the image forming method using a photosensitive member having such an unevenness surface profile, at the time of outputting a high-MTF chart in a case where, e.g., one line/one space images are formed at 600 dpi, the toner is liable to be trapped in depressed portions on the photosensitive member surface when passing through a developing nip, even at positions having low latent image charge density, tending to lower line reproducibility.

As discussed above, according to the conventional techniques, certain effects can be achieved on improvement in running performance, improvement in cleaning performance and prevention of image defects. However, under existing circumstances, there remains room to further improve overall performance.

SUMMARY OF THE INVENTION

An object of the present invention is to provide an image forming method which can maintain good cleaning performance, can minimize the occurrence of smeared images, is superior in line reproducibility and has high toner transfer performance even in long-term service, and to provide an electrophotographic apparatus for carrying out such an image forming method.

As a result of extensive studies, the present inventors have discovered that the physical properties of a toner and the surface profile of a photosensitive member may be controlled within specific ranges to thereby remedy the above problems effectively, thus they have accomplished the present invention.

More specifically, the present invention is concerned with an image forming method having: a charging step of charging a photosensitive member for holding thereon an electrostatic latent image; an exposure step of forming an electrostatic latent image on the photosensitive member by imagewise exposure; a developing step of developing the electrostatic latent image with a toner a developing device has, to form a toner image; and a transfer step of transferring to a transfer material the toner image formed on the surface of the photosensitive member; wherein the toner has toner particles containing at least a binder resin and a colorant, and inorganic fine powder; and the photosensitive member has on its surface a plurality of depressed portions which are independent of one another, and the openings of the depressed portions have an average minor-axis diameter Lpc satisfying the following expression (1):

$$Dg<Lpc<Dt \quad (1)$$

where Dt represents the weight-average particle diameter of the toner, and Dg represents the maximum number-average particle diameter among number-average particle diameters of one or tow or more types of inorganic fine powder constituting the inorganic fine powder.

The present invention is also concerned with an electrophotographic apparatus which has a photosensitive member, a charging means, an exposure means, a developing means, a transfer means and a cleaning means, and uses the above image forming method to reproduce an image.

According to the present invention, an image forming method can be provided which can maintain good cleaning performance, can minimize the occurrence of smeared images, is excellent in dot reproducibility and has high toner transfer performance even in long-term service and in various service environments, and can provide an electrophotographic apparatus for carrying out such an image forming method.

Further features of the present invention will become apparent from the following description of exemplary embodiments with reference to the attached drawings.

DESCRIPTION OF THE EMBODIMENTS

Figure 1:
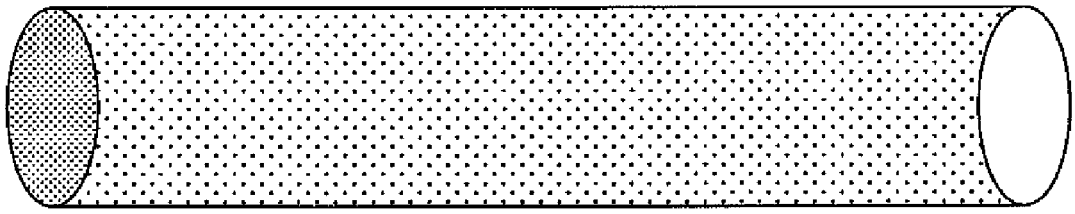
FIG. 1 is a view showing an example of the surface of the electrophotographic photosensitive member having a plurality of depressed portions independent from one another.
Figure 2A:
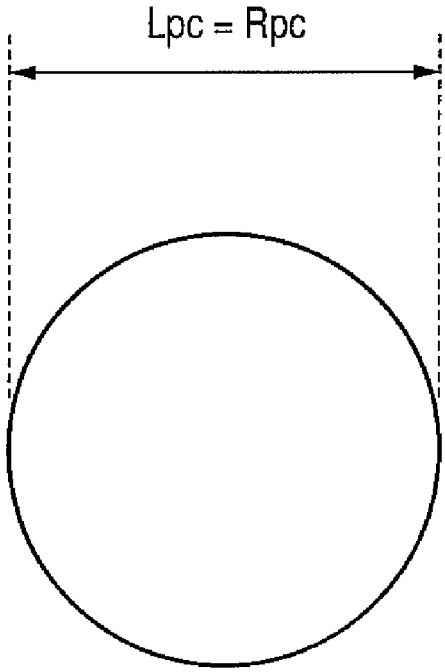
FIG. 2A is a view showing an example of the shape of an opening of each depressed portion on the electrophotographic photosensitive member surface in the present invention.
Figure 2B:
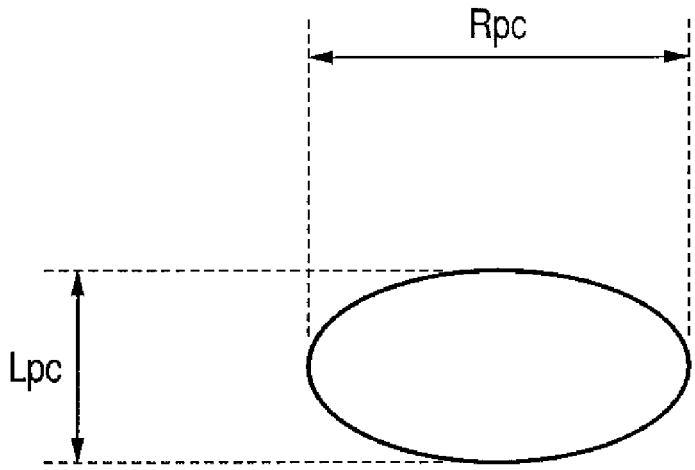
FIG. 2B is a view showing an example of the shape of an opening of each depressed portion on the electrophotographic photosensitive member surface in the present invention.
Figure 2C:
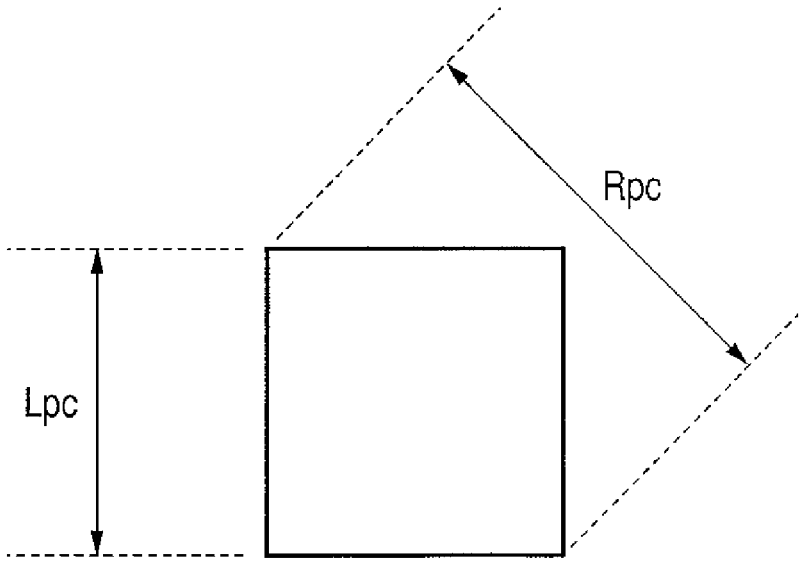
FIG. 2C is a view showing an example of the shape of an opening of each depressed portion on the electrophotographic photosensitive member surface in the present invention.
Figure 2D:
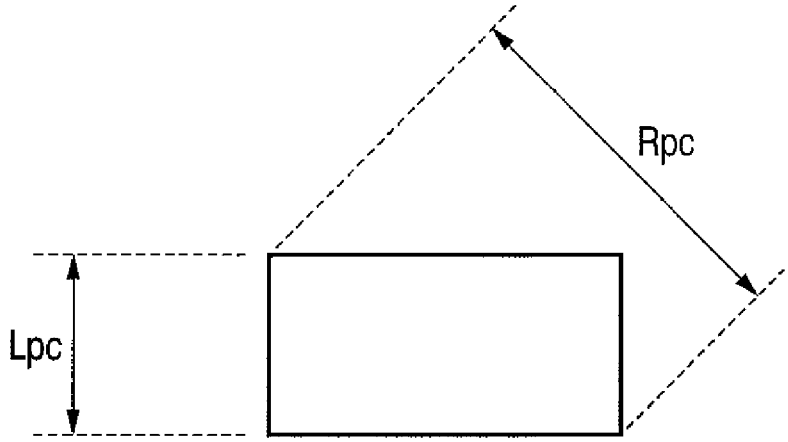
FIG. 2D is a view showing an example of the shape of an opening of each depressed portion on the electrophotographic photosensitive member surface in the present invention.
Figure 2E:
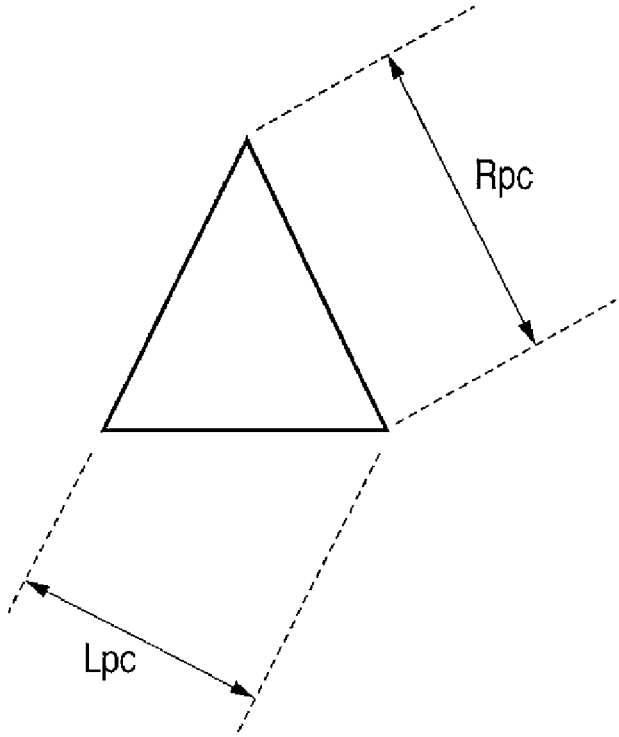
FIG. 2E is a view showing an example of the shape of an opening of each depressed portion on the electrophotographic photosensitive member surface in the present invention.
Figure 2F:
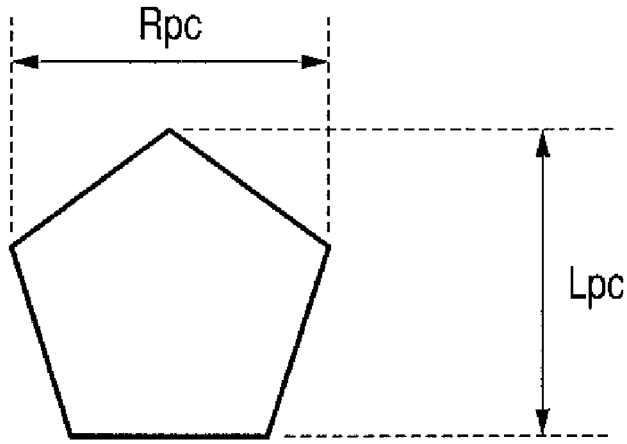
FIG. 2F is a view showing an example of the shape of an opening of each depressed portion on the electrophotographic photosensitive member surface in the present invention.
Figure 2G:
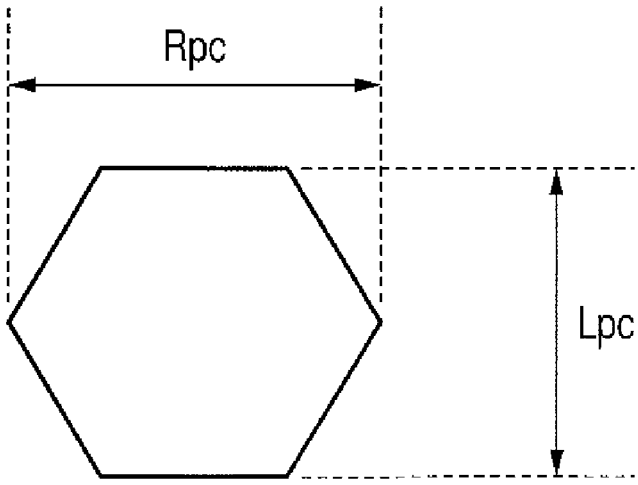
FIG. 2G is a view showing an example of the shape of an opening of each depressed portion on the electrophotographic photosensitive member surface in the present invention.

FIG. 1 shows an example of the surface of the electrophotographic photosensitive member having a plurality of depressed portions which are independent of one another, FIGS. 2A to 2G show examples of the specific shapes of openings of such depressed portions and FIGS. 3A to 3F show examples of the specific shapes of cross sections of the respective depressed portions. The openings may have various shapes as shown in FIGS. 2A to 2G, such as a circle, an ellipse, a square, a rectangle, a triangle and a hexagon. The cross sections may have various shapes as shown in FIGS. 3A to 3F, for example, shapes having edges such as a triangle, a quadrangle and a polygon, wavy shapes each composed of a continuous curve, and shapes in which part or all of the edges of the triangle, quadrangle or polygon has been transformed into a curve or curves.

The depressed portions formed on the surface of the electrophotographic photosensitive member may all have the same shape, size and depth, or may have different shapes and sizes which are present in a mixed state.

As shown in FIGS. 2A to 2G, the lengths of the shortest and longest straight lines among the straight lines obtained by projecting the opening of each depressed portion in the horizontal direction are defined as a minor-axis diameter and a major-axis diameter, respectively. For example, in the case of a circle, the diameter is employed as the minor-axis diameter; in the case of an ellipse, the minor axis; and in the case of a rectangle, the side which is shorter among its sides. For example, in the case of a circle, the diameter is employed as the major-axis diameter; in the case of an ellipse, the major axis; and in the case of a quadrangle, the diagonal which is longer among its diagonals.

Figure 3A:
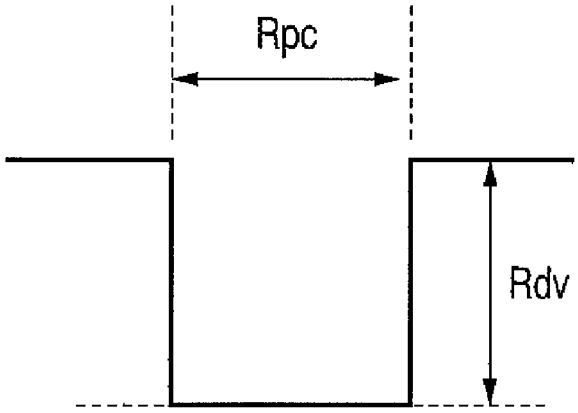
FIG. 3A is a view showing an example of the shape of a cross section of each depressed portion on the electrophotographic photosensitive member surface in the present invention.
Figure 3B:
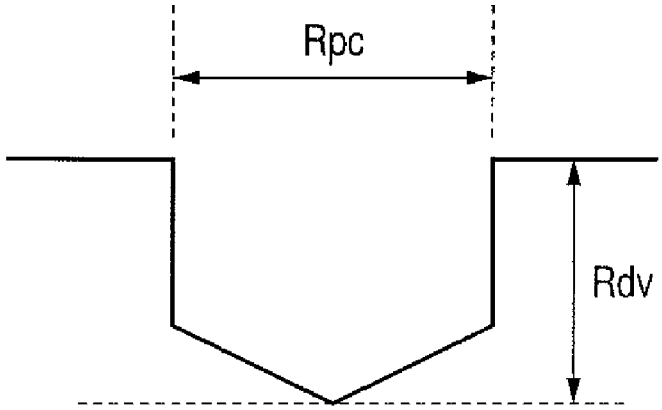
FIG. 3B is a view showing an example of the shape of a cross section of each depressed portion on the electrophotographic photosensitive member surface in the present invention.
Figure 3C:
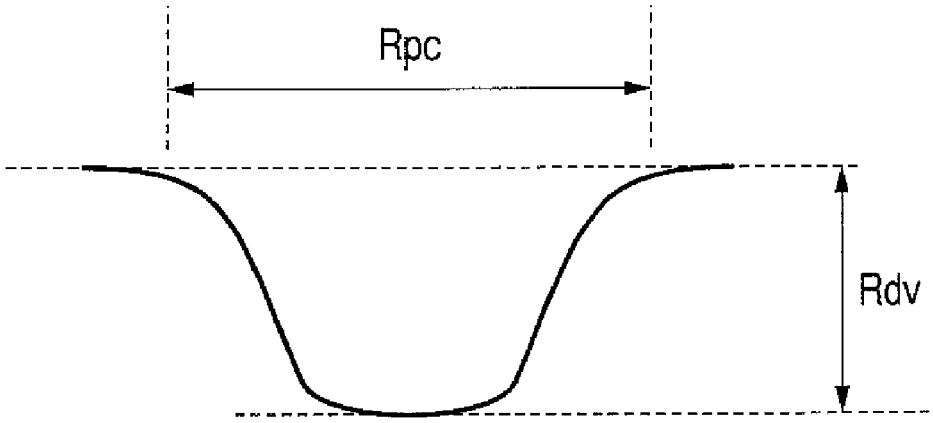
FIG. 3C is a view showing an example of the shape of a cross section of each depressed portion on the electrophotographic photosensitive member surface in the present invention.
Figure 3D:
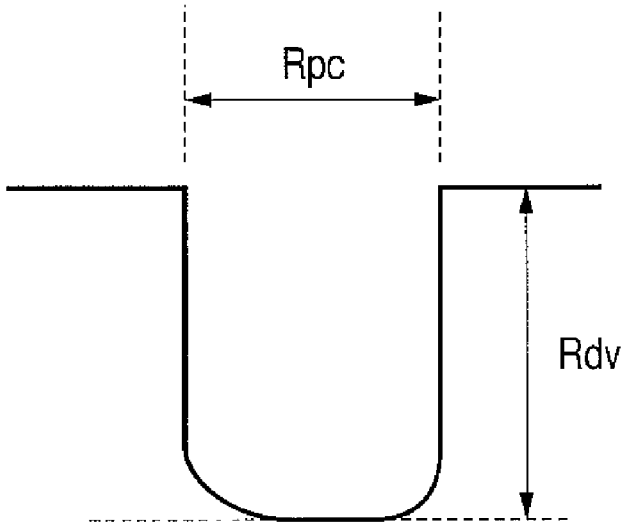
FIG. 3D is a view showing an example of the shape of a cross section of each depressed portion on the electrophotographic photosensitive member surface in the present invention.
Figure 3E:
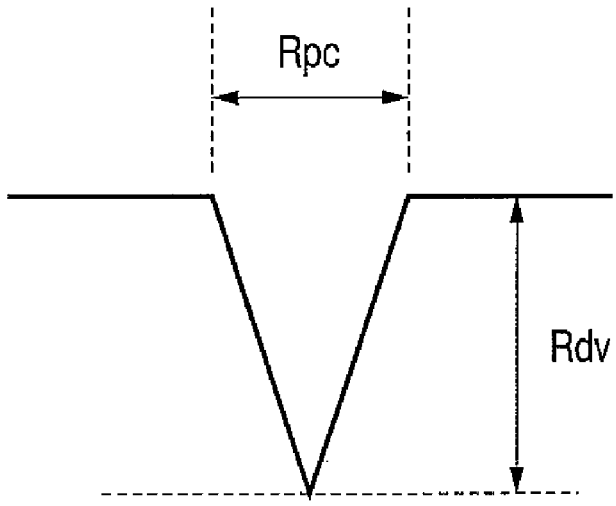
FIG. 3E is a view showing an example of the shape of a cross section of each depressed portion on the electrophotographic photosensitive member surface in the present invention.
Figure 3F:
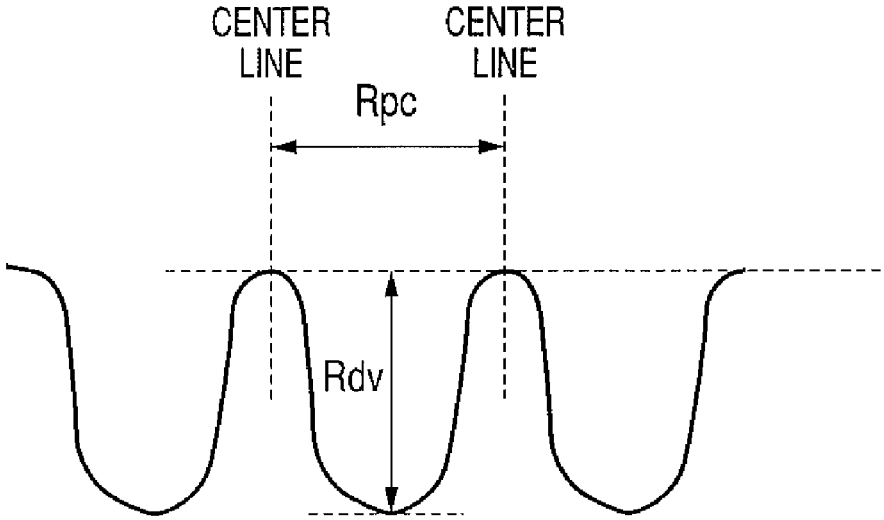
FIG. 3F is a view showing an example of the shape of a cross section of each depressed portion on the electrophotographic photosensitive member surface in the present invention.

In the measurement of a minor-axis diameter and major-axis diameter, e.g., when the boundary between a depressed portion and a non-depressed portion is unclear as shown in FIG. 3C, taking into account its cross-sectional shape and based on the flat surface before the formation of the depressed portion, the shape of the opening of the depressed portion is determined, and the minor-axis diameter and major-axis diameter are measured in the same way as in the above. Further, when the flat surface before the formation of depressed portions is unclear as shown in FIG. 3F, center lines are drawn in the cross-sectional views of the depressed portions adjacent to each other, and the minor-axis diameter and major-axis diameter are measured.

The surface of a photosensitive member to be measured is equally divided into 4 portions in its rotational direction and then equally divided into 25 portions in the direction crossing at right angles with its rotational direction to form 100 portions in total. In each of the 100 portions, a 100 μm square region is formed, and the measurement is made on the depressed portions embraced in the square region. The minor-axis diameters and major-axis diameters of the respective depressed portions per unit area thus determined are statistically processed, and their average values are defined as the average minor-axis diameter and the average major-axis diameter, respectively. In the present specification, the major-axis diameter and the average major-axis diameter are both represented by reference character Rpc, and the minor-axis diameter and the average minor-axis diameter are both represented by reference character Lpc.

One of characteristic features of the electrophotographic photosensitive member in the present invention is that, in the electrophotographic photosensitive member disclosed already in WO2005-093518, the dimple-shaped depressed portions have more finely been formed. This brings about a significant reduction of the frictional resistance itself against the cleaning blade to consequently improve the cleaning performance. In this case, it has been found that when $Lpc<Dt$, transfer efficiency is improved and cleaning performance is enhanced. It is more preferable that $Lpc<Dt-\sigma$ ($Dt-\sigma$ represents the value found by subtracting standard deviation of particle size distribution of toner from Dt). This is considered due to the fact that when $Lpc<Dt$ in the electrophotographic photosensitive member having depressed portions on its surface, the contact area of the toner to the photosensitive member can be reduced.

In addition, it has been discovered that when $Dg<Lpc$, toner filming resistance can be suitably maintained at the time of long-term service and cleaning performance is enhanced.

It is commonly considered that the good cleaning performance is expressed in a state that toner particles and external additives remaining on the surface of the photosensitive member without being transferred are present between the cleaning blade and the electrophotographic photosensitive member. That is, in conventional techniques, the cleaning performance is considered to be brought about by utilizing part of the toner remaining without being transferred. If the toner present between the cleaning blade and the electrophotographic photosensitive member is not at a proper level, problems such as toner melt adhesion may arise in some cases because of an increase in frictional resistance with the remaining toner. Specifically, the good cleaning performance has been expressed when the toner remaining without being transferred is in a sufficiently large quantity. However, where the transfer efficiency the toner is high, the toner present at the cleaning blade edge is in an extremely small quantity when a pattern having a low print density is printed in a large volume and when monochrome printing is continuously performed in a tandem type electrophotographic system. Hence, the frictional resistance between the cleaning blade and the electrophotographic photosensitive member tends to increase. As a result, the toner melt adhesion is liable to occur.

In contrast, the electrophotographic photosensitive member according to the present invention shows a tendency to be unable to easily utilize the effect of developers concerned with cleaning as in conventional techniques, because the toner is very high in transfer efficiency as described later. However, it is considered that because of the remarkably small frictional resistance between the electrophotographic photosensitive member and the cleaning blade, good cleaning performance is retained even though the toner present between them is at a small level. It is also considered that when $Dg<Lpc$, the external additives can be retained in the interiors of dimples in good efficiency, thereby contributing to the good cleaning performance.

Thus, according to the image forming method of the present invention, faulty cleaning is apt to be difficult to bring about even when printing in a low print density is performed in a large volume and when monochrome printing is continuously performed in a tandem type electrophotographic system.

Figure 4A:
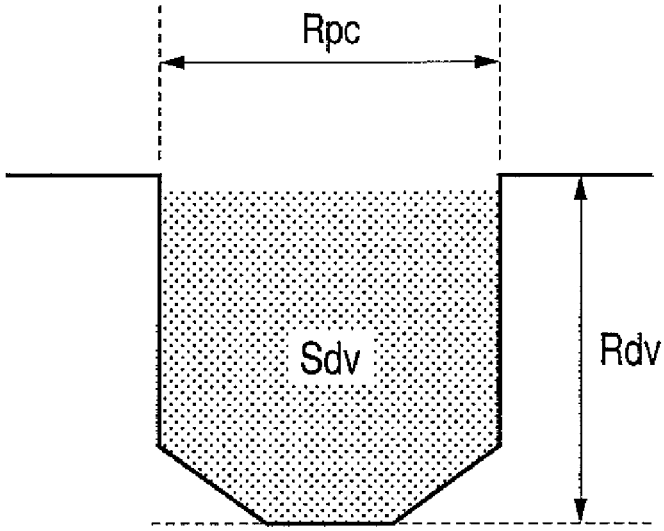
FIG. 4A is a view showing an example of the shape of a cross section of each depressed portion on the electrophotographic photosensitive member surface in the present invention.
Figure 4B:
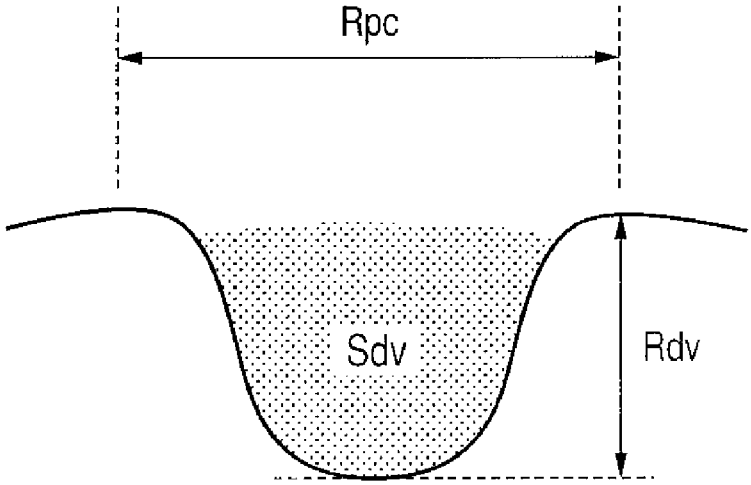
FIG. 4B is a view showing an example of the shape of a cross section of each depressed portion on the electrophotographic photosensitive member surface in the present invention.

Specific examples of the depressed portions are shown in FIGS. 2A to 2G and FIGS. 3A to 3F. Of these, dimple-shaped depressed portions are preferred in which, as shown in FIGS. 4A and 4*b*, in the cross section of the dimple that includes the major-axis diameter of the opening of the depressed portion and is perpendicular to the rotational axis of the photosensitive member, where the major-axis diameter is represented by Rpc and the depth is represented by Rdv, the area of the cross section Sdv satisfies the relationship of $Sdv<Rdv\times Rpc$. Specifically, a shape is preferred in which the dimple diameter becomes smaller in the depth direction with respect to the dimple diameter at the reference surface. It is more preferable that the dimple is composed of a continuous curved surface in which no clear boundary is present between the flat surface (reference surface) before formation of the dimple and the dimple. Such a shape makes the contact between the cleaning blade and the electrophotographic photosensitive member surface smoother to easily effect good cleaning performance. In view of dot reproducibility, it is preferable to satisfy $(1/2)\times Rdv\times Rpc<Sdv$.

Further, the total area of openings of dimples may preferably be 40% or more, and more preferably 61% or more, with respect to the whole surface area of the electrophotographic photosensitive member. If the total area of openings of dimples is too small, the effect of the present invention may be difficult to achieve.

In order to suppress smeared images (line-shaped image defects), it is preferable that the dimples are isolated from one another and, in particular, dimple-shaped depressed portions are not connected with one another in streaks in the peripheral direction or generatrix direction (rotational axis direction) of the electrophotographic photosensitive member, as disclosed already in the publication WO2005-093518. In this regard, the present invention is common thereto. In the electrophotographic photosensitive member according to the present invention, the sizes of dimples have been made remarkably smaller than the latent image spot diameter. This brings about an improvement in dot reproducibility of more minute characters or letters.

In the present invention, the dimple-shaped depressed portions of the surface of the electrophotographic photosensitive member can be measured with a commercially available laser microscope. For example, the following are usable: ultradepth profile measuring microscopes VK-8550 and VK-8700, manufactured by Keyence Corporation; a surface profile measuring system SURFACE EXPLORER SX-520DR model instrument, manufactured by Ryoka Systems Inc.; a scanning conforcal laser microscope OLS3000, manufactured by Olympus Corporation; and a real-color conforcal microscope OPTELICS C130, manufactured by Lasertec Corporation. Using any of these laser microscopes, the minor-axis diameter Lpc of openings of dimples, the major-axis diameter Rpc or longest diameter Epc (described later) of openings of dimples and the depth Rdv and sectional area Sdv of dimples which are present in a certain visual field may be measured at given magnifications. Further, the area percentage of openings of dimples per unit area can be found by calculation.

Measurement with Surface Explorer SX-520DR model instrument, using an analytical program, is described as an example. An electrophotographic photosensitive member to be measured is placed on a work stand. The tilt is adjusted to bring the stand to a level, and three-dimensional profile data of the peripheral surface of the electrophotographic photosensitive member are taken in the analyzer in a wave mode, where the objective lens may be set at 50 magnifications under observation in a visual field of 100 μm×100 μm (10,000 $\mu m^2$). By this method, the surface of the photosensitive member to be measured is equally divided into 4 regions in the rotational direction of the photosensitive member, then equally divided into 25 regions in the direction crossing at right angles with the rotational direction of the photosensitive member to form 100 regions in total, and in each of these regions, a 100 μm square region is formed to make a measurement.

Next, contour line data of the surface of the electrophotographic photosensitive member are displayed by using a particle analytical program set in the data analytical software.

Hole analytical parameters of depressed portions, such as the shape, major-axis diameter, depth and opening area of the depressed portion, may be optimized according to the dimples formed. For example, where dimples of about 10 μm in longest diameter are observed and measured, the upper limit of longest diameter may be set at 15 μm; the lower limit of longest diameter, at 1 μm; the lower limit of depth, at 0.1 μm; and the lower limit of volume, at 1 $\mu m^3$ or more. Then, the number of depressed portions determined to be dimple-shaped on an analytical picture is counted, and the resultant value is regarded as the number of the depressed portions.

Under the same visual field and analytical conditions as in the above, the total opening area of the depressed portions may be calculated from the opening areas of respective dimples that is found by using the above particle analytical program, and the opening area percentage of depressed portions (hereinafter, what is simply noted as "area percentage" refers to this opening area percentage) may be calculated according to the following expression.

[(Total opening area of depressed portions)/(total area)]×100(%).

Depressed Portions of about 1 μm or less in opening major-axis diameter may be measured with a laser microscope and an optical microscope. However, where measurement precision should be enhanced, it is preferable to perform observation and measurement with an ultradepth profile measuring microscope VK-9500, VK-9500 GII or VK-9700, manufactured by Keyence Corporation; a violet laser microscope such as Nanosearch Microscope SFT-3500, manufactured by Shimadzu Corporation; or an electron microscope such as Real Surface View Microscope VE-7800, VE-8800 or VE-9800, manufactured by Keyence Corporation, or CARRY SCOPE JCM-5100, manufactured by JOEL Ltd.

Now, in the present invention, a method by which the dimple-shaped depressed portions are formed on the surface of the electrophotographic photosensitive member may include, e.g., laser abrasion processing. Where the dimple-shaped depressed portions are formed on the photosensitive member surface by laser abrasion processing, the laser light being used may preferably have an oscillation pulse width of 1 ps or more and 100 ns or less. If the laser light has a oscillation pulse width of less than 1 ps, it may be difficult to obtain the shape in which the dimple diameter becomes smaller in the depth direction with respect to the dimple diameter on the reference surface, and also production costs increase. On the other hand, if the laser light has an oscillation pulse width of more than 100 ns, the surface tends to be damaged by heat to make it difficult to obtain dimples with the desired diameter. As the laser light having an oscillation pulse width of from 1 ps or more to 100 ns or less, excimer laser light may preferably be used.

The excimer laser used in the present invention is a laser from which light is emitted when discharge, electron-beam or X-ray energy is applied to a mixed gas of a rare gas such as Ar, Kr or Xe and a halogen gas such as F or Cl to excite and combine these elements, then the energy comes down to the ground state to cause dissociation.

The gas used in the excimer laser may include ArF, KrF, XeCl and XeF. In particular, KrF or ArF is preferred.

Figure 5:
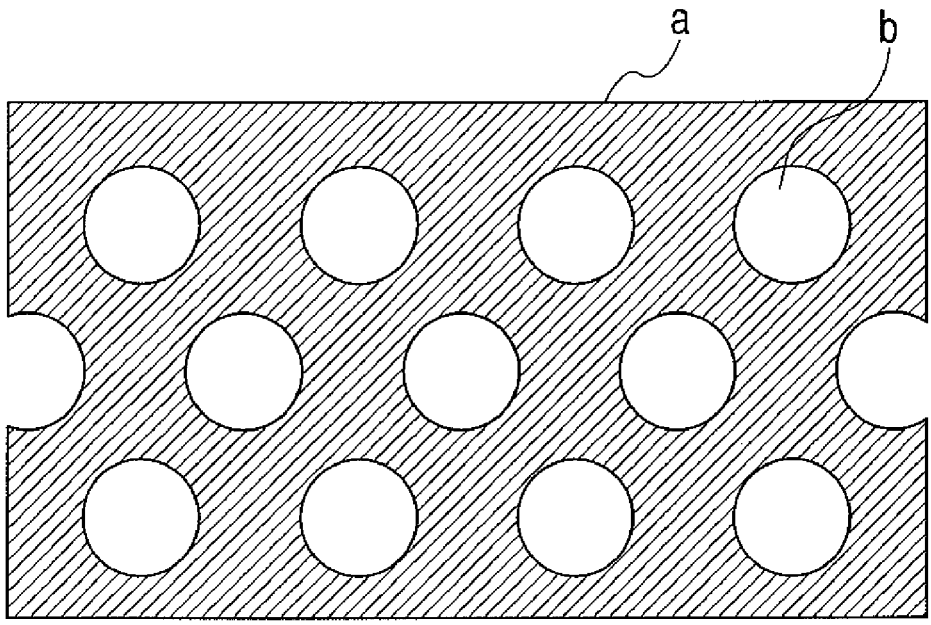
FIG. 5 is a view showing an example of an arrangement pattern of a mask (partial enlarged view) in the present invention.
Figure 6:
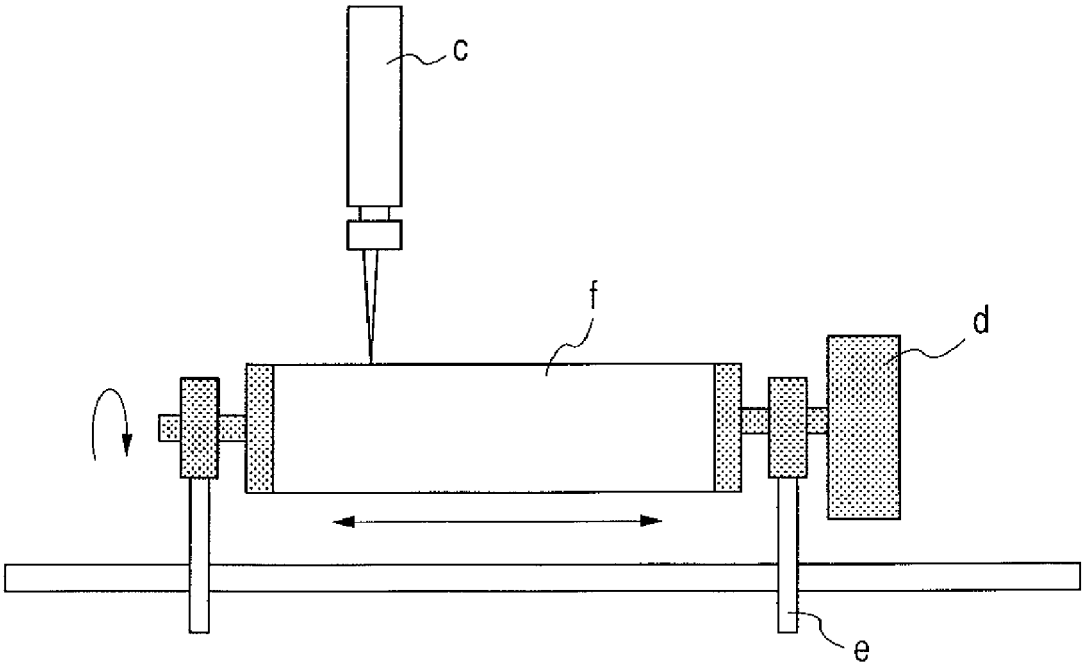
FIG. 6 is a schematic view showing an example of a laser processing unit in the present invention.

In a method of forming the depressed portions, a mask is used in which opaque areas to laser light "a" and transparent areas to laser light "b" are appropriately arranged as shown in FIG. 5. Only laser light having been transmitted through the mask is converged with a lens, and an object to be processed is irradiated with the light. This enables the depressed portions having the desired shape and arrangement to be formed. A large number of depressed portions in a certain area can instantly and simultaneously be formed regardless of the shape and area of the depressed portions, and hence the step of surface processing can be completed in a short time. By the laser light irradiation using such a mask in a processing unit shown in FIG. 6, the surface is processed in the region of from several $mm^2$ to several $cm^2$ per irradiation made once with an excimer laser light irradiator c. In such laser processing, as shown in FIG. 6, a photosensitive member (e.g., a photosensitive drum) f is rotated by a work rotating motor while the laser light irradiation position is shifted in the axial direction of the photosensitive member f by a work movement unit e. This enables formation of the depressed portions in good efficiency over the whole surface of the photosensitive member. The depressed portions may preferably be formed in a depth of from 0.1 μm to 2.0 μm. According to the present invention, the processing for surface roughening can be materialized with high controllability for the size, shape and arrangement of the depressed portions, in a high precision and at a high degree of freedom.

Figure 7:
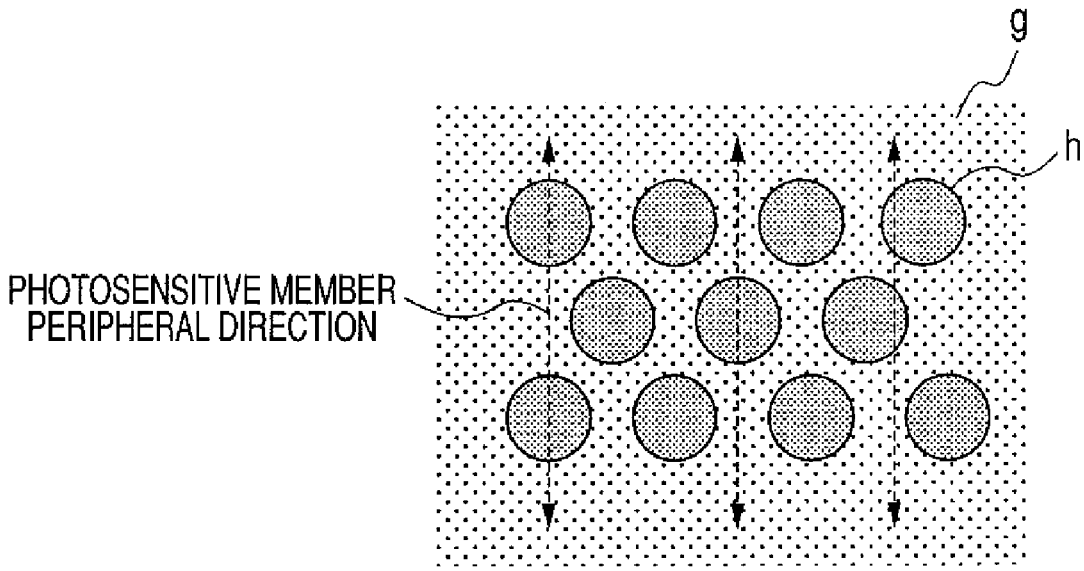
FIG. 7 is a view showing an example of an arrangement pattern of depressed portions (partial enlarged view) of the photosensitive member outermost surface obtained according to the present invention.

In the present invention, surface processing repeated by using the same mask pattern may be employed. In such a case, the photosensitive member can have high surface-roughening uniformity over the whole surface. As a result, the mechanical load to be applied to the cleaning blade when used in an electrophotographic apparatus can be uniform. Also, as shown in FIG. 7, the mask pattern may be so formed that both depressed portion-formed areas h and non-depressed portion-formed areas g are present on any lines in the peripheral direction of the photosensitive member surface, thereby it is possible to further prevent the mechanical load applied to the cleaning blade from being localized.

In the present invention, another method by which the dimple-shaped depressed portions are formed on the surface of the electrophotographic photosensitive member may include a method of transferring a surface profile by bringing a mold having a given surface profile into pressure contact with the surface of the electrophotographic photosensitive member.

Figure 8:
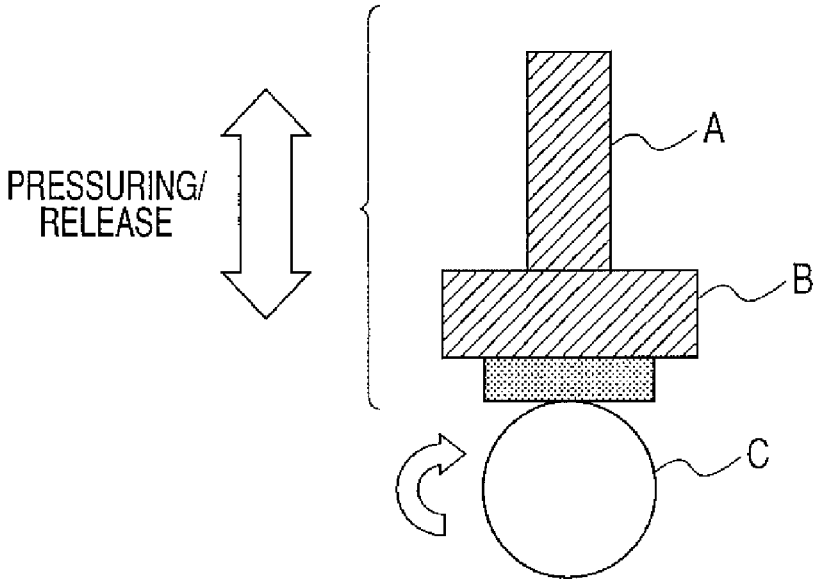
FIG. 8 is a schematic view showing an example of a pressure contact profile transfer processing unit using a mold in the present invention.

FIG. 8 schematically illustrates a cross section of a processing unit for such a method. A given mold B is fitted to a pressuring unit A which can repeatedly perform pressuring and release, and thereafter brought into contact with a photosensitive member C at a given pressure to transfer the surface profile. Thereafter, the pressuring or pressing is released once and the photosensitive member C is rotated, and then pressuring is again performed to carry out the step of transferring the surface profile. By repeating this step, given dimple-shaped depressed portions can be formed over the whole peripheral surface of the photosensitive member.

Figure 9:
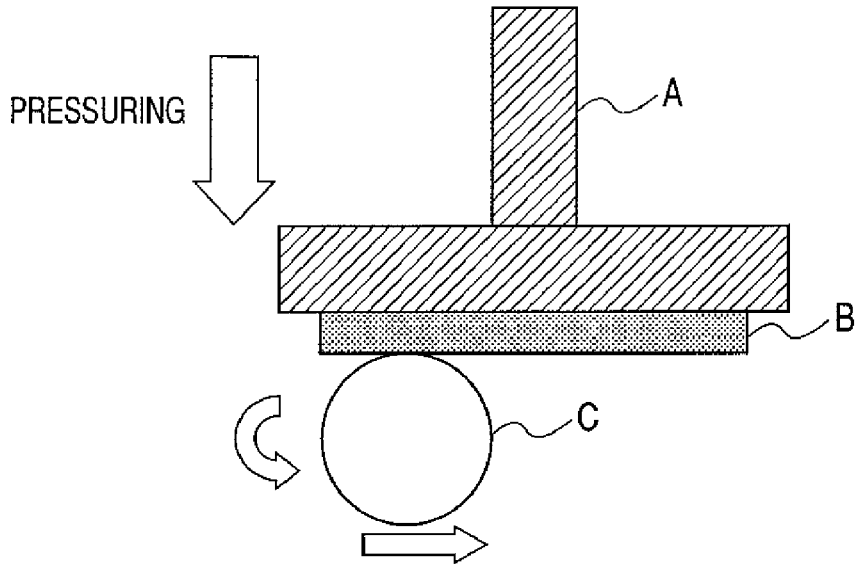
FIG. 9 is a view showing another example of a pressure contact profile transfer processing unit using a mold in the present invention.

Alternatively, as shown in FIG. 9, a profile-providing material B which is longer than the whole peripheral length of the photosensitive member may be fitted to the pressuring unit A, and thereafter, under application of a give pressure to the photosensitive member C, the photosensitive member is rotated and moved in the directions shown by arrows to form given dimple-shaped depressed portions over the whole peripheral surface of the photosensitive member.

As another example, a sheet-like mold may be held between a roll-shaped pressuring unit and the photosensitive member to carry out surface processing while feeding the mold sheet. For the purpose of efficiently effecting the surface profile transfer, the mold and the photosensitive member may be heated.

Figure 10A:
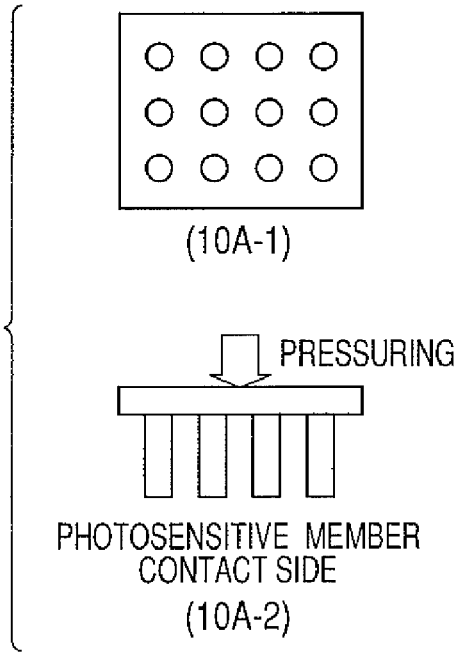
FIG. 10A is a view showing an example of the shape of a mold in the present invention.
Figure 10B:
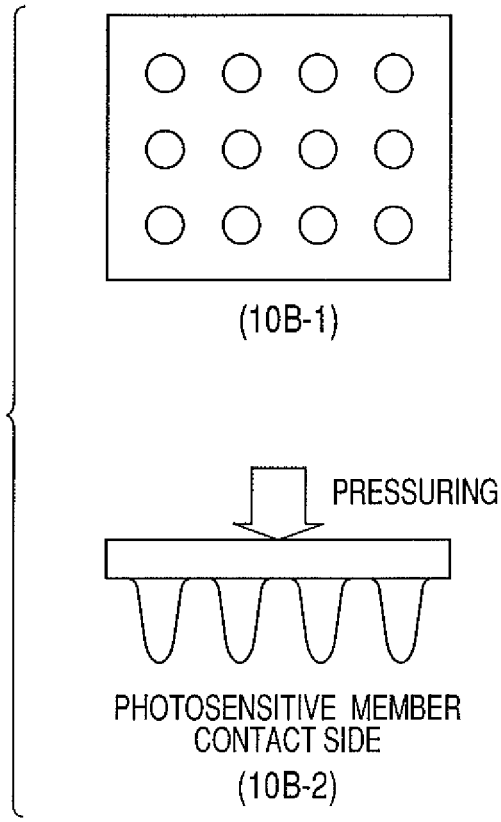
FIG. 10B is a view showing another example of the shape of a mold in the present invention.

The material, size and surface profile of the mold itself may appropriately be selected. The material may include a finely surface-processed metal, and a silicon wafer the surface of which has been patterned using a resist, fine-particle-dispersed resin films, and a resin film having a given fine surface profile which has been coated with a metal. Examples of the surface profile of the mold are shown in FIGS. 10A and 10B. In FIG. 10A, view 10A-1 shows the surface profile of the mold as viewed from its top, and view 10A-2 shows the surface profile of the mold as viewed from its side. In FIG. 10B, view 10B-1 shows the surface profile of the profile-providing material as viewed from its top, and view 10B-2 shows the surface profile of the profile-providing material as viewed from its side.

An elastic member may also be fitted between the mold and the pressuring unit to uniformly apply pressure to the photosensitive member with pressure.

To measure the average particle diameter of the inorganic fine powder in the present invention, the surfaces of toner particles enlarged at 500,000 magnifications with a scanning electron microscope FE-SEM (S-4700, manufactured by Hitachi Ltd.) are photographed, and this enlarged photograph is used as a object to be measured. As to the average particle diameter of primary particles, their particle diameters are measured over 10 visual fields in the enlarged photograph, and the average thereof is regarded as the average particle diameter. Parallel lines tangent to the contour of a primary particle of the fine inorganic powder are drawn, and among the distances between the parallel lines, the maximum distance is regarded as the particle diameter.

At least 500 particles of 0.001 μm or more in particle diameter are picked out at random from the enlarged photograph. Parallel lines tangent to the contour of each particle are drawn, and among the distances between parallel lines, the maximum distance is regarded as the particle diameter. The number-average particle diameter is calculated on the basis of a particle diameter(s) at a peak(s) in particle size distribution of the 500 or more particles.

Where only one peak is present, the particle diameter value at the peak is regarded as the maximum value of number-average particle diameter of the inorganic fine powder. Where two or more peaks are present, the particle diameter value at the maximum peak among the peaks is regarded as the number-average particle diameter of the inorganic fine powder.

A weight-average particle diameter of the toner can preferably be measured by an aperture electrical-resistance method. In the present invention, the weight-average particle diameter of the toner is measured with Coulter Multisizer II (manufactured by Coulter Electronics, Inc.). As an electrolytic solution, a 1% NaCl aqueous solution prepared using first-grade sodium chloride may be used. For example, ISOTON R-II (available from Coulter Scientific Japan Co.) may be used. As a measuring method, 0.3 ml of a surface active agent (preferably an alkylbenzenesulfonate) is added as a dispersant to 100 to 150 ml of the above aqueous electrolytic solution, and 2 to 20 mg of a sample for measurement is further added. The electrolytic solution in which the sample has been suspended is subjected to dispersion for about 1 minute to about 3 minutes in an ultrasonic dispersion machine. The volume and number of toner particles are measured with the above measuring instrument, and their volume distribution and number distribution are calculated to determine the weight average particle diameter (D4) (the median of each channel is used as the representative value for each channel) and its standard deviation.

Where the weight-average particle diameter is larger than 6.0 μm, a 100 μm aperture is used to measure particles of 2 to 60 μm. Where the weight-average particle diameter is 3.0 to 6.0 μm, a 50 μm aperture is used to measure particles of 1 to 30 μm. Where the weight-average particle diameter is less than 3.0 μm, a 30 μm aperture is used to measure particles of 0.6 to 18 μm.

In the present invention, the particle shape of the toner is defined by average circularity and shape factors.

The average circularity of the toner is measured with a flow type particle analyzer "FPIA-2100 Model" (manufactured by Sysmex Corporation), and is calculated using the following expressions.

$$\text{Circle-equivalent diameter} = (\text{particle projected area}/n)^{1/2} \times 2.$$

$$\text{Circularity} = \frac{\text{Circumferential length of a circle with the same area as particle projected area}}{\text{Circumferential length of particle projected image.}}$$

Here, the "particle projected area" refers to the area of a binary-coded toner particle image, and the "circumferential length of particle projected image" is defined as the length of a contour line formed by connecting edge points of the toner particle image. In the measurement, the circumferential length of a particle image in image processing at an image processing resolution of 512×512 (a pixel of 0.3 μm×0.3 μm) is used.

The circularity referred to in the present invention is an index showing the degree of surface unevenness of toner particles. It is indicated as 1.000 when the toner particles are perfectly spherical. The more complicate the surface shape, the smaller the value of circularity is.

Average circularity C which means an average value of circularity frequency distribution is calculated from the following expression where the circularity at a division point i of particle size distribution (median) is represented by ci, and the number of particles measured is represented by m.

$$\text{Average circularity } C = \sum_{i=1}^{m} ci/m.$$

The measuring instrument "FPIA-2100" used in the present invention calculates the circularity of each particle and thereafter calculates the average circularity, where, according to the resulting circularities, particles are divided into classes in which circularities of from 0.4 to 1.00 are equally divided at intervals of 0.01, and the average circularity is calculated using the medians of the division points and the number of particles measured.

As to a specific manner of measurement, 10 ml of ion exchange water from which impurity solid matter has been removed is readied in a container, and a surface active agent, preferably an alkylbenzenesulfonate, is added thereto as a dispersant. Thereafter, 0.02 g of a sample for measurement is further added and uniformly dispersed. As a means for dispersing it, an ultrasonic dispersion machine "TETORA 150 Model" (manufactured by Nikkaki Bios Co.) is used, and dispersion treatment is carried out for 2 minutes to prepare a liquid dispersion for measurement. In that case, the liquid dispersion is appropriately cooled so that its temperature does not come to 40° C. or more. In order to keep the circularity from scattering, the flow type particle analyzer FPIA-2100 is installed in an environment controlled to 23° C. plus minus 0.5° C. so that its in machine temperature can be kept at 26 to 27° C., and auto-focus control is performed using 2 μm latex particles at intervals of a certain time, and preferably at intervals of 2 hours.

In measuring the circularity of the toner, the above flow type particle analyzer is used and the concentration in the liquid dispersion is controlled again so that the toner concentration at the time of measurement is 3,000 to 10,000 particles/μl, where 1,000 or more toner particles are measured. After the measurement, using the data obtained, the data of particles with a circle-equivalent diameter of less than 2 μm are cut, and the average circularity of the particles is determined.

The measuring instrument "FPIA-2100" used in the present invention is, compared with "FPIA-1000" having ever been used to calculate the shape of toner particles, an instrument having been improved in precision of measurement of toner particle shapes because of an improvement in magnification of processed particle images and also an improvement in processing resolution of images captured (256×256→512×512), thereby having achieved surer capture of fine particles. Accordingly, where the particle shapes must more accurately be measured as in the present invention, FPIA-2100 is more advantageous, which can more accurately obtain information concerning the particle shapes.

The toner particles may preferably have an average circularity of from 0.925 to 0.995. If they have an average circularity of less than 0.925, their transfer efficiency may begin to lower, resulting in an increase in probability of toner filming during extensive operation. On the other hand, if they have an average circularity of more than 0.995, the toner itself may very well roll over and is liable to escape at the time of cleaning, consequently tending to cause faulty cleaning.

Meanwhile, as to the shape factors of the toner, using, e.g., FE-SEM (S-4700 or 4800) manufactured by Hitachi Ltd, 100 of 2 μm or larger toner particle images enlarged at 1,000 magnifications are picked up at random. The image information obtained is introduced into, e.g., ANALYSIS (Soft Imaging System GmbH) through an interface to make an analysis. The values obtained by calculation according to the following expressions are defined as SF-1 and SF-2.

$$SF\text{-}1 = \{(MXLNG)^2/\text{AREA}\} \times (\Pi/4) \times 100$$

$$SF\text{-}2 = \{(PERIME)^2/\text{AREA}\} \times (1/4\pi) \times 100$$

(where MXLNG represents the absolute maximum length of a particle, PERIME represents the peripheral length of the particle, and AREA represents the projected area of the particle.)

Where the shape factors of the toner are measured by the above method after external additives have been added to toner particles, the analysis is so made that the external additives adhering to the surfaces of toner particles is not included in the image analytical data.

The shape factor SF-1 represents the degree of overall roundness of particles, and the shape factor SF-2 represents the degree of fine unevenness of particle surfaces.

The toner may preferably have a shape factor ratio (SF-2)/(SF-1) of from 0.63 or more and 1.00 or less. If the toner has the shape factor ratio (SF-2)/(SF-1) of more than 1.00, faulty cleaning tends to occur. If the toner has a shape factor SF-1 of more than 160, its particles are away from being spherical and come close to being amorphous, so that the toner is liable to be crushed in a developing device to tend to vary in particle size distribution or have broad charge quantity distribution, and hence tends to cause a decrease in image density or fogging such as background fogging or reversal fogging. If the toner has a shape factor SF-2 of more than 140, it may cause a lowering of transfer efficiency of toner images from the photosensitive member to an intermediate transfer member and transfer materials, and may undesirably bring about blank areas caused by poor transfer in characters and line images.

It is preferable that the relationship between the average circularity of the toner and the photosensitive member surface profile satisfy the following expression:

$$C \geqq -0.0241 \times \mathrm{Log}(\tan^{-1}((Epc-Epch)/Edv)/Epc)+0.917$$

Where Epc represents the longest diameter in the photosensitive member peripheral direction of an opening of each independent depressed portion;

Edv represents the maximum depth of the cross section of the depressed portion that includes the peripheral-direction longest diameter and is perpendicular to the rotational axis of the photosensitive member;

Epch represents the diameter in the photosensitive member peripheral direction of the depressed portion at a depth of half the maximum depth; and C represents the average circularity of the toner.

In the region of $C<-0.0241\times\mathrm{Log}(\tan^{-1}((Epc-Epch)/Edv)/Epc)+0.917$, at the time of reproduction of a high-MTF chart in a case in which, e.g., one line/one space images are formed at 600 dpi, the toner tends to be trapped in the depressed portions of the photosensitive member surface when passing through a developing nip, even at positions having low latent image charge density, tending to cause a lowering of line reproducibility.

There are no particular limitations on how to produce the toner in the present invention. In order to control the average circularity, it may preferably be produced by suspension polymerization, or mechanical pulverization with spherical treatment. In order for the toner to have an average circularity of from 0.925 to 0.950, the mechanical pulverization with spherical treatment is particularly preferred. In order for the toner to have an average circularity of from 0.950 to 0.995, the suspension polymerization is particularly preferred.

The particle shape of the toner may preferably be within the above range. This range is achievable by controlling pulverization conditions or surface treatment or modification treatment conditions for the toner.

The present invention acts most effectively when using an electrophotographic photosensitive member the surface of which does not easily wear. The electrophotographic photosensitive member the surface of which does not easily wear is highly durable, and on the other hand, tends to cause cleaning blade chattering or turn-up, electrostatic memory of electrophotographic photosensitive member caused by rubbing, smeared images and problems on developing performance and transfer performance.

In the present invention, the surface of the electrophotographic photosensitive member of the present invention may preferably have a modulus of elastic deformation of from 40% or more and 65% or less, more preferably from 45% or more, and still more preferably from 50% or more.

The surface of the electrophotographic photosensitive member may also preferably have a universal hardness value (HU) of from 150 $N/mm^2$ or more and 220 $N/mm^2$ or less.

If the surface of the electrophotographic photosensitive member has too large a universal hardness value (HU) or too low a modulus of elastic deformation, it has insufficient elastic force. Hence, any paper dust or toner held between the peripheral surface of the electrophotographic photosensitive member and the cleaning blade may rub the peripheral surface of the electrophotographic photosensitive member and tend to scratch and abrade the surface of the electrophotographic photosensitive member.

In addition, if the surface has too large a universal hardness value (HU), it inevitably has a small level of elastic deformation even though it has a high modulus of elastic deformation. As a result, a large pressure may locally be applied to the surface of the electrophotographic photosensitive member, thus tending to deeply scratch the surface of the electrophotographic photosensitive member.

If the surface, though having a universal hardness value (HU) within the above range, has too low a modulus of elastic deformation, it inevitably has a relatively large level of plastic deformation. Hence, the surface of the electrophotographic photosensitive member tends to become finely scratched and also tend to become worn. This comes to be remarkable especially when the surface has not only too low a modulus of elastic deformation, but also too small a universal hardness value (HU).

The electrophotographic photosensitive member the surface of which does not easily wear and further is not be easily scratched may cause only a very small change, or no change, in the above fine surface profile from the initial stage until after being repeatedly used. Hence, it can well maintain the performance at the initial stage even when it has repeatedly been used for a long period of time.

In the present invention, the universal hardness value (HU) and modulus of elastic deformation of the surface of the electrophotographic photosensitive member may be measured with a microhardness measuring instrument FISCHER SCOPE H100V (manufactured by Fischer Co.) in an environment of temperature 23° C./humidity 50% RH. This FISCHER SCOPE H100V is an instrument in which an indenter is brought into touch with an object to be measured (the peripheral surface of the electrophotographic photosensitive member) and a load is continuously applied to this indenter, where the depth of indentation under application of the load is directly read to find the hardness continuously.

In the present invention, a Vickers pyramid diamond indenter having angles of 136 degrees between the opposite faces is used. The indenter is pressed against the peripheral surface of the electrophotographic photosensitive member. The last of load (final load) applied continuously to the indenter is set to be 6 mN, and the time (retention time) for which the state of applying the final load of 6 mN to the indenter is retained is set to be 0.1 second. Also, measurement is made at 273 spots.

Figure 11:
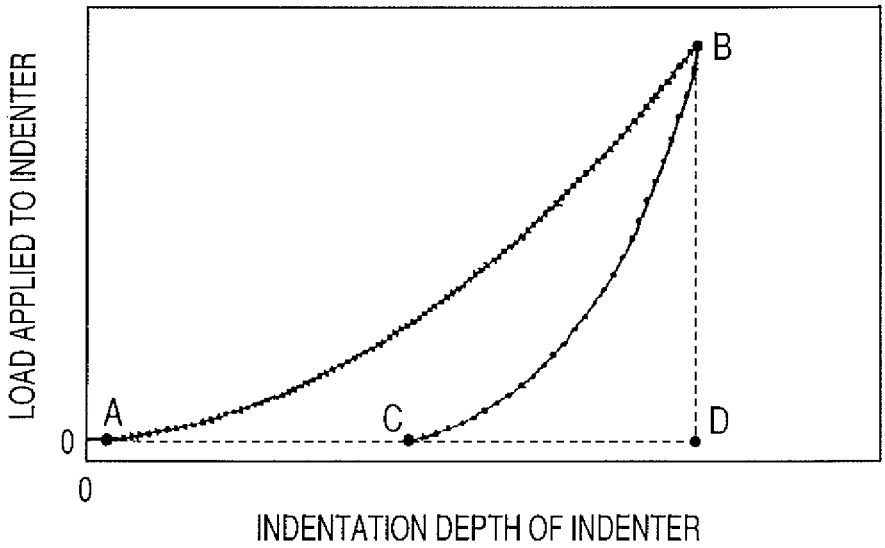
FIG. 11 is a graph showing the outline of an output chart of Fischer Scope H100V (manufactured by Fischer Co.).
Figure 12:
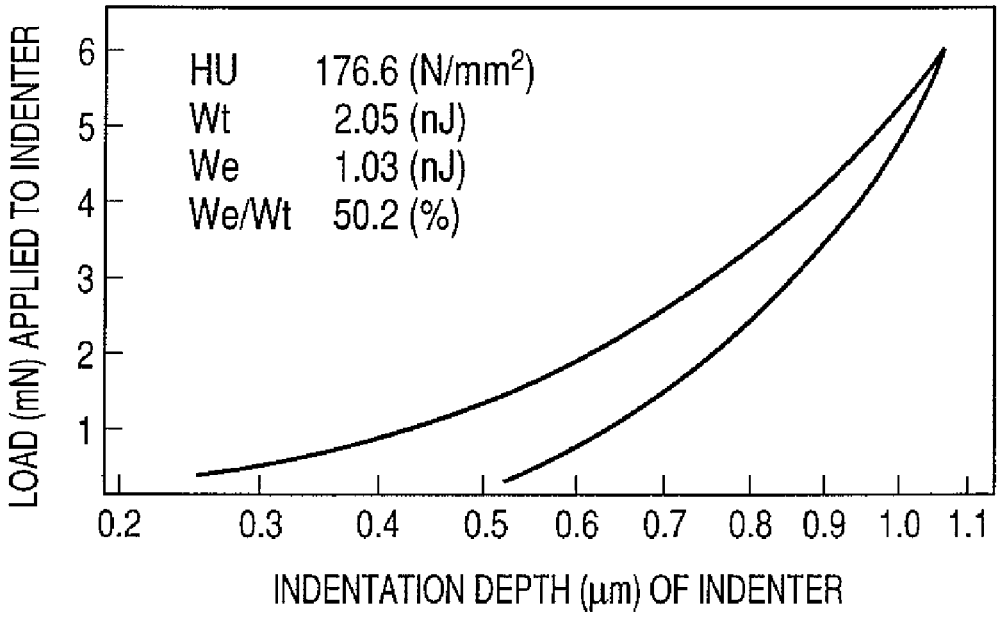
FIG. 12 is a graph showing an example of an output chart of Fischer Scope H100V (manufactured by Fischer Co.).

The outline of an output chart of FISCHER SCOPE H100V (manufactured by Fischer Co.) is shown in FIG. 11. An example of an output chart of FISCHER SCOPE H100V (manufactured by Fischer Co.) at the time the electrophotographic photosensitive member of the present invention is an object to be measured is shown in FIG. 12. In FIGS. 11 and 12, the load F (mN) applied to the indenter is plotted as ordinate, and the depth of indentation h (μm) of the indenter as abscissa. FIG. 11 shows results obtained when the load F applied to the indenter is increased stepwise until the load comes to be maximum (from A to B), and thereafter the load is decreased stepwise (from B to C). FIG. 12 shows results obtained when the load applied to the indenter is increased stepwise until the load comes finally to be 6 mN, and thereafter the load is decreased stepwise.

The universal hardness value (HU) may be found from the depth of indentation at the time the final load of 6 mN is applied to the indenter, and from the following expression. In the following expression, HU stands for the universal hardness (HU), $F_f$ stands for the final load, $S_f$ stands for the surface area of the part where the indenter is penetrated under application of the final load, and $h_f$ stands for the indentation depth of the indenter at the time the final load is applied.

$$HU=F_f[N]/S_f[\mathrm{mm}^2]=6\times10^{-3}/(26.43\times(h_f\times10^{-3})^2).$$

The modulus of elastic deformation may be found from the work done (energy) by the indenter against the object to be measured (the peripheral surface of the electrophotographic photosensitive member), i.e., a change in energy due to an increase and decrease in load of the indenter against the object to be measured (the peripheral surface of the electrophotographic photosensitive member). Specifically, the value found when the elastic deformation work done We is divided by the total work done Wt (We/Wt) is the modulus of elastic deformation. The total work done Wt corresponds to the area of the region surrounded by A-B-D-A in FIG. 11, and the elastic deformation work done We corresponds to the area of the region surrounded by C-B-D-C in FIG. 11.

The constitution of the electrophotographic photosensitive member according to the present invention is described below.

As mentioned previously, the electrophotographic photosensitive member in the present invention has a support and an organic photosensitive layer (hereinafter also simply "photosensitive layer") provided on the support. Commonly, a cylindrical organic electrophotographic photosensitive member is being widely used in which a photosensitive layer is formed on a cylindrical support, which may be in the shape of a belt or a sheet.

The photosensitive layer may be either of a single-layer type photosensitive layer which contains a charge transporting material and a charge generating material in the same layer and a multi-layer type (function-separated type) photosensitive layer which is separated into a charge generation layer containing a charge generating material and a charge transport layer containing a charge transporting material. From the viewpoint of electrophotographic performance, the multi-layer type photosensitive layer is preferred. The multi-layer type photosensitive layer may be a regular-layer type photosensitive layer in which the charge generation layer and the charge transport layer are superposed in this order from the support side and a reverse-layer type photosensitive layer in which the charge transport layer and the charge generation layer are superposed in this order from the support side. From the viewpoint of electrophotographic performance, the regular-layer type photosensitive layer is preferred. The charge generation layer may be constituted of multiple layers, and the charge transport layer may also be constituted of multiple layers. A protective layer may further be provided on the photosensitive layer for the purpose of improving durability.

If a material has conductivity, it is sufficient to be a support (a conductive support). A support is usable which is made of a metal (or made of an alloy) such as iron, copper, gold, silver, aluminum, zinc, titanium, lead, nickel, tin, antimony, indium, chromium, aluminum alloy or stainless steel. Also, a support is usable which is made of a metal or a plastic having a layer formed by vacuum deposition of aluminum, an aluminum alloy or an indium oxide-tin oxide alloy. A support is also usable which is formed from plastic or paper impregnated with conductive particles such as carbon black, tin oxide particles, titanium oxide particles or silver particles together with a suitable binder resin, and is made of a plastic containing a conductive binder resin.

For the purpose of preventing interference fringes caused by scattering of laser light from occurring, the surface of the support may be subjected to cutting, surface roughening or aluminum anodizing.

A conductive layer for the prevention of interference fringes caused by scattering of laser light or for the covering of scratches of the support surface may be provided between the support and an intermediate layer described later or the photosensitive layer (charge generation layer or charge transport layer).

The conductive layer may be formed using a conductive layer coating fluid prepared by dispersing and/or dissolving carbon black, a conductive pigment or a resistance control pigment in a binder resin. A compound capable of being cure-polymerized upon heating or irradiation may be added to the conductive layer coating fluid. With the conductive layer in which a conductive pigment or a resistance control pigment has been dispersed, its surface tends to be roughened.

The conductive layer may preferably have a layer thickness of from 0.2 μm to 40 μm, and more preferably from 1 μm to 35 μm, and still more preferably from 5 μm to 30 μm.

The binder resin used for the conductive layer may include the following: Polymers or copolymers of vinyl compounds such as styrene, vinyl acetate, vinyl chloride, acrylate, methacrylate, vinylidene fluoride and trifluoroethylene, polyvinyl alcohol, polyvinyl acetal, polycarbonate, polyester, polysulfone, polyphenylene oxide, polyurethane, cellulose resins, phenol resins, melamine resins, silicon resins and epoxy resins.

The conductive pigment and the resistance control pigment may include particles of metals (or alloys) such as aluminum, zinc, copper, chromium, nickel, silver and stainless steel, and plastic particles the surfaces of which any one of these metals has or have been vacuum-deposited on. They may also be particles of metal oxides such as zinc oxide, titanium oxide, tin oxide, antimony oxide, indium oxide, bismuth oxide, indium oxide doped with tin, and tin oxide doped with antimony or tantalum. These may each be used alone or in combination with each other. Where they are used in combination with each other, they may simply be mixed, or may be made into a solid solution or may be in the form of fusion.

An intermediate layer having a function as a barrier and a function of adhesion may also be provided between the support or the conductive layer and the photosensitive layer (charge generation layer or charge transport layer). The intermediate layer is formed for the purposes of improving the adherence of the photosensitive layer, coating performance and the injection of electric charges from the support, and protecting the photosensitive layer from electrical breakdown.

Materials for the intermediate layer may include the following: Polyvinyl alcohol, poly-N-vinyl imidazole, polyethylene oxide, ethyl cellulose, an ethylene-acrylic acid copolymer, casein, polyamide, N-methoxymethylated nylon 6, copolymer nylons, glue and gelatin. The intermediate layer may be formed by coating an intermediate layer coating solution prepared by dissolving any one of those materials in a solvent, and drying the wet coating formed.

The intermediate layer may preferably be in a layer thickness of 0.05 μm to 7 μm, and further, more preferably from 0.1 μm to 2 μm.

The charge generating material used in the photosensitive layer in the present invention may include the following: Pyrylium or thiapyrylium type dyes, phthalocyanine pigments having various central metals and various crystal types (such as α, β, γ, ϵ and X forms), anthanthrone pigments, dibenzpyrenequinone pigments, pyranthrone pigments, azo pigments such as monoazo, disazo and trisazo pigments, indigo pigments, quinacridone pigments, asymmetric quinocyanine pigments, quinocyanine pigments, and amorphous silicon. Any one of these charge generating materials may be used alone, or in combination with each other.

The charge transporting material used in the electrophotographic photosensitive member in the present invention may include the following: Pyrene compounds, N-alkylcarbazole compounds, hydrazone compounds, N,N-dialkylaniline compounds, diphenylamine compounds, triphenylamine compounds, triphenylmethane compounds, pyrazoline compounds, styryl compounds and stilbene compounds.

Where the photosensitive layer is functionally separated into a charge generation layer and a charge transport layer, the charge generation layer may be formed in the following way. The charge generating material is dispersed together with a binder resin, which is used in a 0.3- to 4-fold quantity (mass ratio), and a solvent by a method using a homogenizer, an ultrasonic dispersion machine, a ball mill, a vibration ball mill, a sand mill, an attritor or a roll mill, to prepare a charge generation layer coating fluid. The charge generation layer coating fluid thus prepared is applied and dried to form the charge generation layer. The charge generation layer may also be a vacuum-deposited film of the charge generating material.

The charge transport layer may be formed by applying a charge transport layer coating solution prepared by dissolving the charge transporting material and a binder resin in a solvent, and drying the wet coating formed. Of the above charge transporting materials, one having in itself film forming properties may be used singly to form a film without using any binder resin to afford the charge transport layer.

The binder resin used for the charge generation layer and charge transport layer may include the following: Polymers or copolymers of vinyl compounds such as styrene, vinyl acetate, vinyl chloride, acrylate, methacrylate, vinylidene fluoride and trifluoroethylene, polyvinyl alcohol, polyvinyl acetal, polycarbonate, polyester, polysulfone, polyphenylene oxide, polyurethane, cellulose resins, phenol resins, melamine resins, silicon resins and epoxy resins.

The charge generation layer may preferably have a layer thickness of 5 μm or less, and more preferably from 0.1 μm to 2 μm.

The charge transport layer may preferably have a layer thickness of from 5 μm to 50 μm, and more preferably from 10 μm to 35 μm.

To improve durability which is one of properties required in the electrophotographic photosensitive member in the present invention, material designing of the charge transport layer serving as a surface layer is important in the case of the above function-separated type photosensitive layer. As a means therefor, the following may be cited: using a binder resin having high strength, controlling the proportion of a charge-transporting material exhibiting plasticity to the binder resin, and using a charge transporting polymer. In order to bring out more durability, it is effective for the surface layer to be made up of a curable resin.

In the present invention, the charge transport layer itself may be made up of a curable resin. On the above charge transport layer, a curable resin layer may be formed as a second charge transport layer or a protective layer. Properties required for the curable resin layer are both film strength and charge-transporting ability, and such a layer is commonly made up of a polymerizable or cross-linkable monomer or oligomer.

As the charge-transporting material, any known hole-transporting compounds or electron-transporting compounds may be used. The polymerizable or cross-linkable monomer or oligomer may include chain polymerization type materials having an acryloyloxyl group or a styrene group, and successive polymerization type materials having a hydroxyl group, an alkoxysilyl group or an isocyanate group. From the viewpoints of resultant electrophotographic performance, general-purpose properties, material designing and production stability, it is preferable to use a hole-transporting compound and a chain polymerization type material in combination. Further, a system is particularly preferred in which a compound having both a hole-transporting group and an acryloyoxyl group in the molecule is cured. As a curing means, any known means may be used utilizing heat, light or radiation.

Such a cured layer may preferably have, in the case of the charge transport layer, a layer thickness of from 5 μm to 50 μm, and more preferably from 10 μm to 35 μm, as in the foregoing. In the case of the second charge transport layer or the protective layer, it may preferably have a layer thickness of from 0.1 μm to 20 μm, and more preferably from 1 μm to 10 μm.

Various additives may be added to the respective layers of the electrophotographic photosensitive member in the present invention. Such additives may include an anti-deterioration agnet such as an antioxidant and an ultraviolet absorber, and lubricants such as fluorine atom-containing resin particles.

Figure 13:
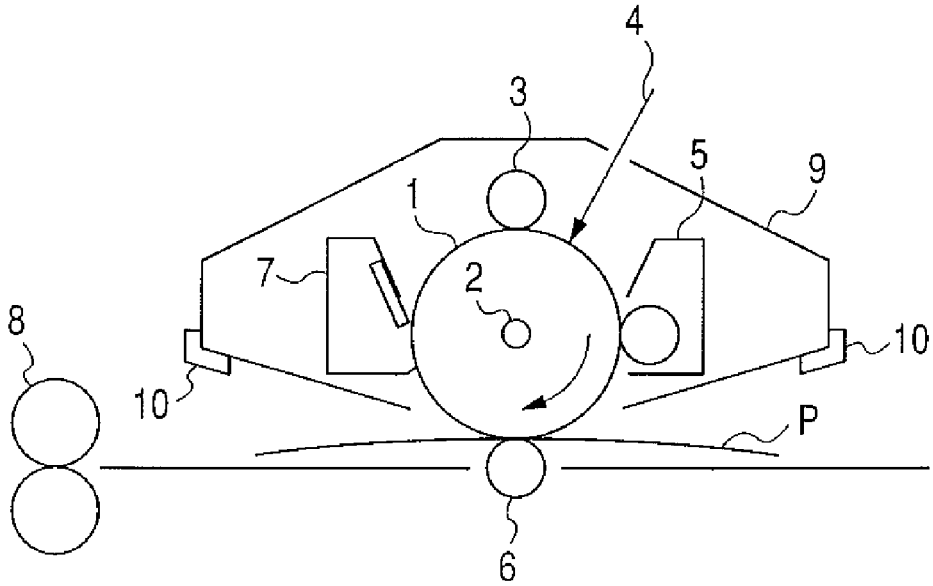
FIG. 13 is a schematic view showing an example of the construction of an electrophotographic apparatus provided with a process cartridge having the electrophotographic photosensitive member according to the present invention.

An example of the construction of an electrophotographic apparatus provided with a process cartridge, suitable for carrying out the image forming method of the present invention is schematically shown in FIG. 13. In FIG. 13, reference numeral 1 denotes a cylindrical electrophotographic photosensitive member (photosensitive drum), which is rotatively driven around an axis 2 in the direction of an arrow at a given peripheral speed.

The surface of the electrophotographic photosensitive member 1 rotatively driven is uniformly charged to a positive or negative, given potential through a charging means (primary charging means such as a charging roller) 3. The electrophotographic photosensitive member thus charged is then exposed to exposure light (imagewise exposure light) 4 emitted from an exposure means (not shown) for slit exposure or laser beam scanning exposure. In this way, electrostatic latent images corresponding to the intended image are successively formed on the peripheral surface of the electrophotographic photosensitive member 1. The charging means 3 is not limited to a contact charging means using the charging roller as shown in FIG. 13, and may be a corona charging means using a corona charging device, or a charging means using any other system.

The electrostatic latent images thus formed on the peripheral surface of the electrophotographic photosensitive member 1 are developed with a toner a developing means 5 has, to become toner images. Then, the toner images thus formed and held on the peripheral surface of the electrophotographic photosensitive member 1 are successively transferred by applying a transfer bias from a transfer means (such as a transfer roller) 6, onto a transfer material (such as plain paper or coated paper) P which is taken out of a transfer material feed means (not shown) in synchronization with the rotation of the electrophotographic photosensitive member 1 and fed to the part (contact zone) between the electrophotographic photosensitive member 1 and the transfer means 6. A system may also be used in which the toner images are first transferred to an intermediate transfer drum or intermediate transfer belt in place of the transfer material and then transferred to the transfer material.

The transfer material P with the toner images transferred thereto is separated from the peripheral surface of the electrophotographic photosensitive member 1, is led to a fixing means 8, where the toner images are fixed, and then discharged out of the apparatus as an image-formed material (a print or a copy).

The peripheral surface of the electrophotographic photosensitive member 1 from which the toner images have been transferred is subjected to removal of the toner remaining after the transfer by a cleaning means (such as a cleaning blade) 7. Thus, its surface is cleaned. It is further de-charged by pre-exposure light (not shown) emitted from a pre-exposure means (not shown), and thereafter repeatedly used for image formation.

In addition, where, as shown in FIG. 13, the charging means 3 is the contact charging means using a charging roller, the pre-exposure is not necessarily required.

A process cartridge may be constituted by integrally holding in a container plural components from among the constituents such as the above electrophotographic photosensitive member 1, charging means 3, developing means 5, transfer means 6 and cleaning means 7. The process cartridge may be so constituted as to be detachably mountable to the main body of an electrophotographic apparatus such as a copying machine or a laser beam printer. In the apparatus shown in FIG. 13, the electrophotographic photosensitive member 1 and the charging means 3, developing means 5 and cleaning means 7 are integrally held to constitute a process cartridge 9 that is detachably mountable to the main body of the electrophotographic apparatus through a guide means 10 such as rails set in the main body of the electrophotographic apparatus.

EXAMPLES

The present invention is described below in greater detail by way of working examples. In the following Examples, "part(s)" is by mass".

(1) Production of Photosensitive Member
Photosensitive Member

Production Example 1

An aluminum cylinder of 84 mm in diameter and 370.0 mm in length, having been subjected to surface cutting, was used as a support (cylindrical support).

Next, 60 parts of a powder (trade name: PASTRAN PC1; available from Mitsui Mining & Smelting Co., Ltd.) composed of barium sulfate particles having coat layers of tin oxide), 15 parts of titanium oxide (trade name: TITANIX JR; available from Tayca Corporation), 43 parts of a resol type phenolic resin (trade name: PHENOLITE J-325; available from Dainippon Ink & Chemicals, Incorporated; solid content: 70% by mass), 0.015 parts of silicone oil (trade name: SH28PA; available from Toray Silicone Co., Ltd.), 3.6 parts of silicone resin (trade name: TOSPEARL 120; available from Toshiba Silicone Co., Ltd.) and a solution composed of 50 parts of 2-methoxy-1-propanol and 50 parts of methanol were subjected to dispersion for about 20 hours by means of a ball mill to prepare a conductive layer coating fluid. The conductive layer coating fluid thus prepared was applied on the aluminum cylinder by dip coating, followed by heat curing for 1 hour in an oven kept at a temperature of 140° C., to form a resin layer with a layer thickness of 15 μm.

Next, a solution prepared by dissolving 10 parts of copolymer nylon resin (trade name: AMILAN CM800; available from Toray Industries, Inc.) and 30 parts of methoxymethylated nylon 6 resin (trade name: TORESIN EF-30T; available from Teikoku Chemical Industry Co., Ltd.) in a mixed solvent of 400 parts of methanol and 200 parts of n-butanol was applied on the above resin layer by dip coating, followed by heat drying for 30 minutes in an oven kept at a temperature of 100° C., to form an intermediate layer with a layer thickness of 0.45 μm.

Next, 20 parts of hydroxygallium phthalocyanine having strong peaks at Bragg angles (2θ±0.2°) of 7.4° and 28.2° in CuKα characteristics X-ray diffraction, 0.2 parts of calixarene represented by the following structural formula (1):

(1)

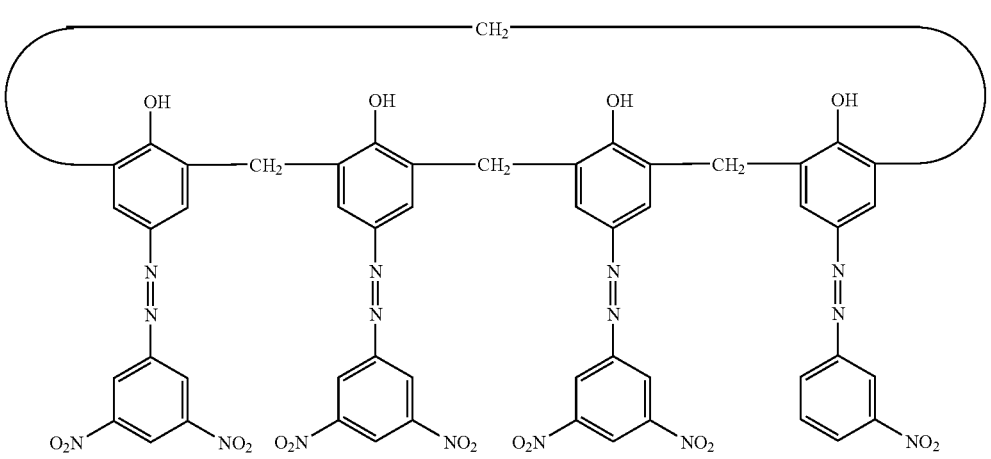

10 parts of polyvinyl butyral (trade name: S-LEC BX-1, available from Sekisui Chemical Co., Ltd.) and 600 parts of cyclohexanone were subjected to dispersion for 4 hours by means of a sand mill using glass beads of 1 mm in diameter, and thereafter 700 parts of ethyl acetate was added to prepare a charge generation layer coating dispersion. This was applied on the intermediate layer by dip coating, followed by heat drying for 15 minutes in an oven kept at a temperature of 80° C., to form a charge generation layer with a layer thickness of 0.170 μm.

Next, 70 parts of a hole transporting compound represented by the following structural formula (2):

(2)

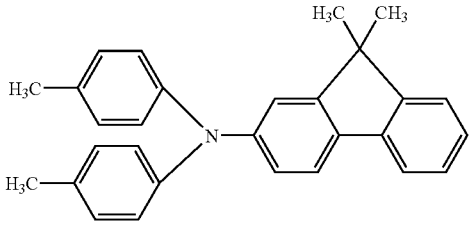

and 100 parts of polycarbonate resin (trade name: IUPILON Z400; available from Mitsubishi Engineering-Plastics Corporation) were dissolved in a mixed solvent of 600 parts of monochlorobenzene and 200 parts of methylal to prepare a charge transport layer coating solution. This charge transport layer coating solution was applied on the charge generation layer by dip coating, followed by heat drying for 30 minutes in an oven kept at a temperature of 100° C., to form a charge transport layer with a layer thickness of 15 μm.

Next, 0.5 part of a fluorine atom-containing resin (trade name: GF-300, available from Toagosei Chemical Industry Co., Ltd.) as a dispersant was dissolved in a mixed solvent of 20 parts of 1,1,2,2,3,3,4-heptafluorocyclopentane (trade name: ZEOROLA H, available from Nippon Zeon Co., Ltd.) and 20 parts of 1-propanol, and thereafter 10 parts of tetrafluoroethylene resin powder (trade name: LUBRON L-2, available from Daikin Industries, Ltd.) was added as a lubricant, and uniformly dispersed four times under a pressure of 58.8 MPa (600 kgf/cm$^2$) by means of a high-pressure dispersion machine (trade name: MICROFLUIDIZER M-110EH, manufactured by Microfluidics Inc., USA). The dispersion obtained was filtered with a Polyfron filter (trade name: PF-040, available from Advantec Toyo Kaisha, Ltd.) to prepare a lubricant dispersion. Thereafter, 90 parts of a hole transporting compound represented by the following formula (3), 70 parts of 1,1,2,2,3,3,4-heptafluorocyclopentane and 70 parts of 1-propanol were added to the lubricant dispersion, followed by filtration with a Polyfron filter (trade name: PF-020, available from Advantec Toyo Kaisha, Ltd.) to prepare a second charge transport layer coating fluid.

(3)

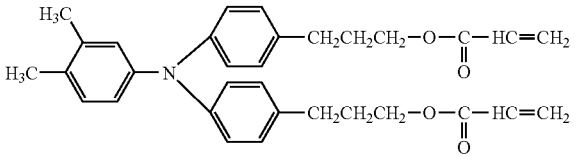

Using this coating fluid, a second charge transport layer was applied on the charge transport layer, followed by drying for 10 minutes in an oven kept at a temperature of 50° C. in the atmosphere. Thereafter, the layer formed was irradiated with electron rays for 1.6 seconds in an atmosphere of nitrogen and under conditions of an accelerating voltage of 150 kV and a beam current of 3.0 mA while rotating the cylinder at 200 rpm. Subsequently, in an atmosphere of nitrogen, the temperature was raised from 25° C. to 125° C. over a period of 30 seconds to carry out curing reaction. Here, the absorbed dose of electron rays was measured and found to be 15 KGy. Oxygen concentration in the atmosphere in which irradiation with electron rays and heat curing reaction were carried out was found to be 15 ppm or less. Thereafter, the resultant electrophotographic photosensitive member was naturally cooled in the atmosphere to a temperature of 25° C., and then subjected to post-heat-treatment for 30 minutes in an oven kept at a temperature of 100° C. in the atmosphere, to form a second charge transport layer with a layer thickness of 5 μm. Thus, an electrophotographic photosensitive member was obtained.

Formation of Depressed Portions by Excimer Laser

Figure 14:
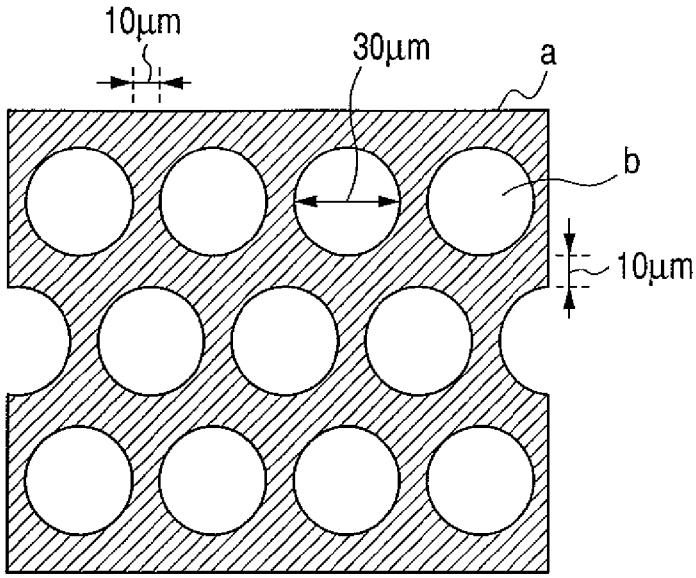
FIG. 14 is a view showing an arrangement pattern of a mask (partial enlarged view) used in Photosensitive Member Production Example 1.

On the outermost surface layer of the electrophotographic photosensitive member obtained, depressed portions were formed by using a KrF excimer laser (wavelength λ: 248 nm; pulse width: 17 ns). In this case, a mask made of quartz glass was used which had a pattern in which, as shown in FIG. 14, circular transparent areas to laser light "b" of 30 μm in diameter were arranged at intervals of 10 μm. Irradiation energy was set at 0.9 J/cm$^{-1}$. The irradiation area was 1.4 mm square for each irradiation. Reference character "a" denotes an opaque area to laser light. As shown in FIG. 6, the photosensitive member was rotated, during which the laser irradiation position was shifted in the axial direction of the photosensitive member, to obtain Photosensitive Member No. 1.

Observation of Depressed Portions Formed

Figure 15A:
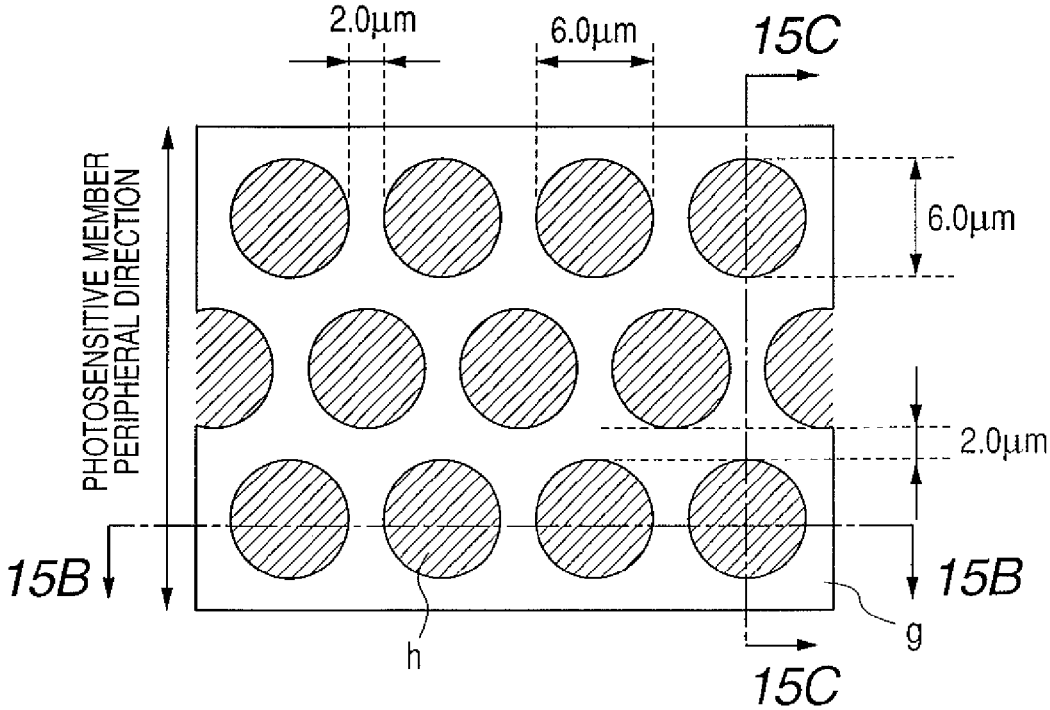
FIG. 15A is a view showing an arrangement pattern of depressed portions (partial enlarged view) of the photosensitive member outermost surface obtained according to Photosensitive Member Production Example 1.
Figure 15B:
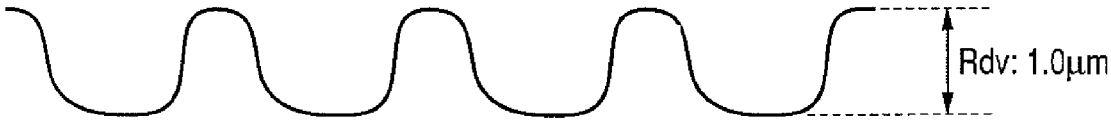
FIG. 15B is a cross-sectional view taken along the line 15B-15B in FIG. 15A.
Figure 15C:
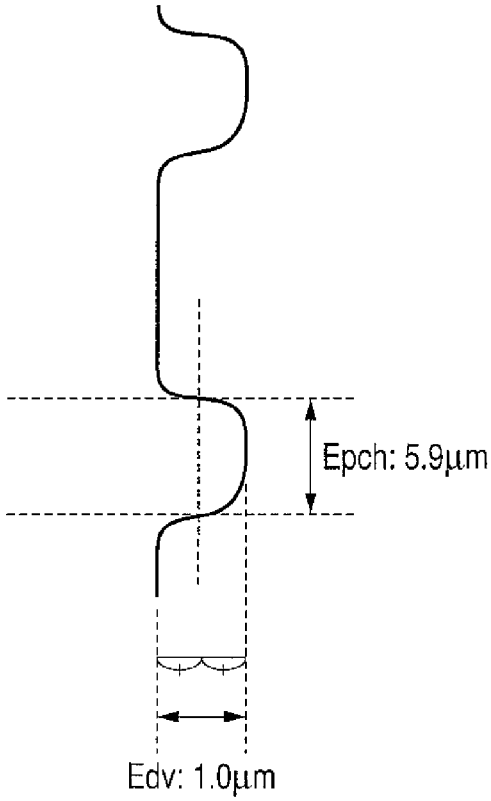
FIG. 15C is a cross-sectional view taken along the line 15C-15C in FIG. 15A.

The surface profile of Photosensitive Member No. 1 obtained was observed under magnification with a laser microscope (VK-9500, manufactured by Keyence Corporation) to ascertain that, as shown in FIG. 15A, edge-free columnar depressed portions were formed at intervals of 2.0 μm in which the minor-axis diameter Lpc and major-axis diameter Rpc of the opening of each of the depressed portions and the longest diameter Epc in the circumferential direction of the photosensitive member were all 6.0 μm. FIG. 15B is a cross-sectional view taken along the line 15B-15B in FIG. 15A. FIG. 15C is a cross-sectional view taken along the line 15C-15C in FIG. 15A. As shown in FIGS. 15B and 15C, both the depths Rdv and Edv of each depressed portion were 1.0 μm, and the opening diameter Epch of each depressed portion at the depth of ½ of the depth Edv was 5.9 μm in the peripheral direction of Photosensitive Member No. 1. The number of depressed portions per 10,000 μm$^2$ was 156, and the area percentage of openings of the depressed portions was 43%.

Measurement of Modulus of Elastic Deformation and Universal Hardness (HU)

Photosensitive Member No. 1 obtained was left standing for 24 hours in an environment of temperature 23° C./humidity 50% RH, and thereafter its modulus of elastic deformation and universal hardness (HU) were measured. As a result, the modulus of elastic deformation was found to be 54%, and the universal hardness (HU) 180 N/mm$^2$.

Photosensitive Member

Production Example 2

Electrophotographic Photosensitive Member No. 2 was produced in the same manner as in Photosensitive Member Production Example 1.

Formation of Depressed Portions by Mold Pressing Profile Transfer

Figure 16:
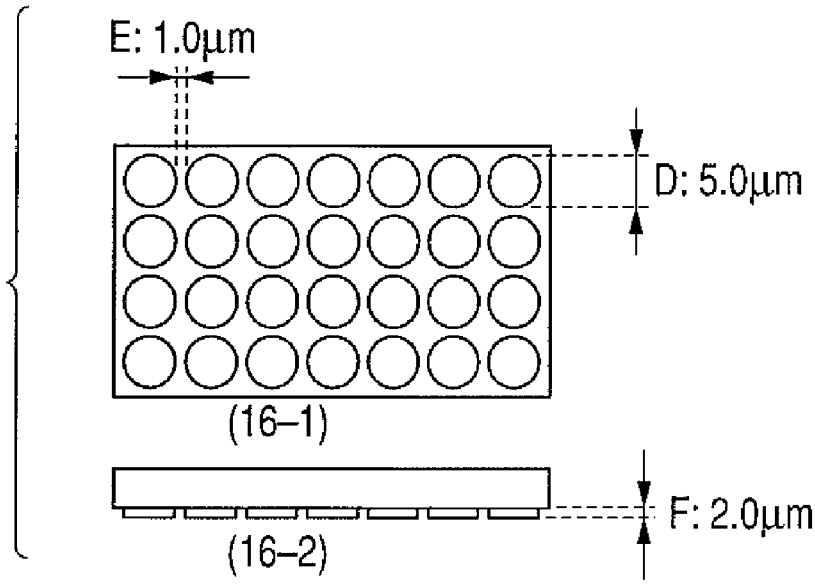
FIG. 16 is a view showing the shape of a mold used in Photosensitive Member Production Example 2.

The electrophotographic photosensitive member obtained was subjected to surface processing by fitting a mold for surface profile transfer as shown in FIG. 16, to the processing unit shown in FIG. 9. In FIG. 16, view 16-1 shows the surface profile of the mold as viewed from its top, and view 16-2 shows the surface profile of the mold as viewed from its side. Reference characters D, E and F stand for the longest diameter, interval and height of protrusions, respectively. The electrophotographic photosensitive member and the mold were temperature-controlled so that the temperature of the charge transport layer at the pressing zone came to be 110° C., and the photosensitive member was rotated in its peripheral direction while pressing with a pressure of 4.9 MPa (50 kg/cm$^2$) to perform surface profile transfer to produce Photosensitive Member No. 2.

Observation of Depressed Portions Formed

Figure 17:
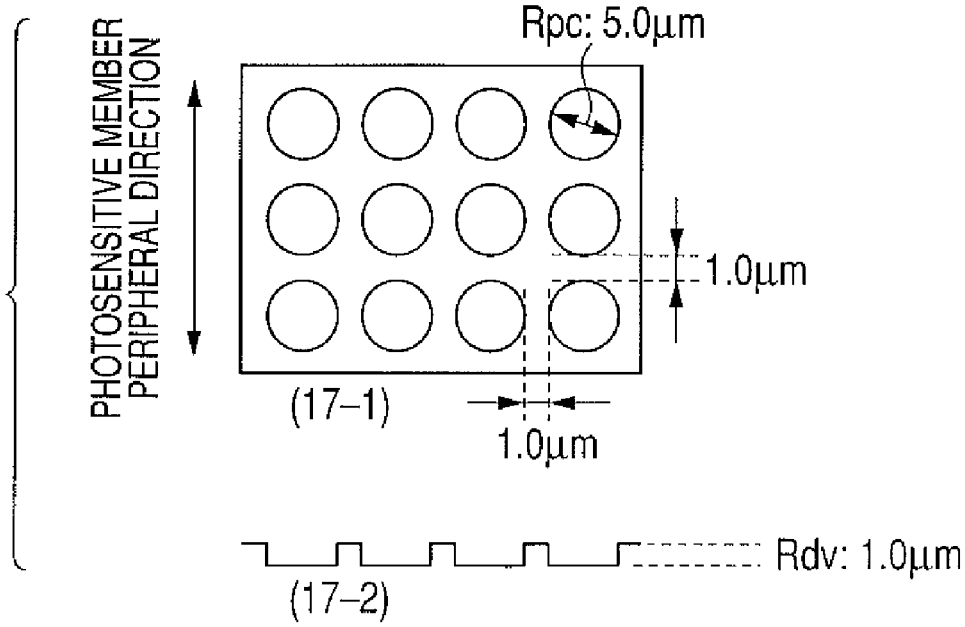
FIG. 17 is a view showing an arrangement pattern of depressed portions (partial enlarged view) of the photosensitive member outermost surface obtained according to Photosensitive Member Production Example 2.

The surface profile of Photosensitive Member No. 2 obtained was observed under magnification with a laser microscope (VK-9500, manufactured by Keyence Corporation) to ascertain that, as shown in FIG. 17, edged columnar depressed portions of 5.0 μm in major-axis diameter Rpc and 1.0 μm in depth Rdv were formed at intervals of 1.0 μm. In FIG. 17, view 17-1 shows how the depressed portions formed on the photosensitive member surface are arranged, and view 17-2 shows a sectional profile of the photosensitive member surface having the depressed portions. The results of surface profile measurement are as shown in Table 1.

Photosensitive Member

Production Example 3

Electrophotographic Photosensitive Member No. 3 was produced in the same manner as in Photosensitive Member Production Example 1.

Formation of Depressed Portions by Mold Pressing Profile Transfer

Figure 18:
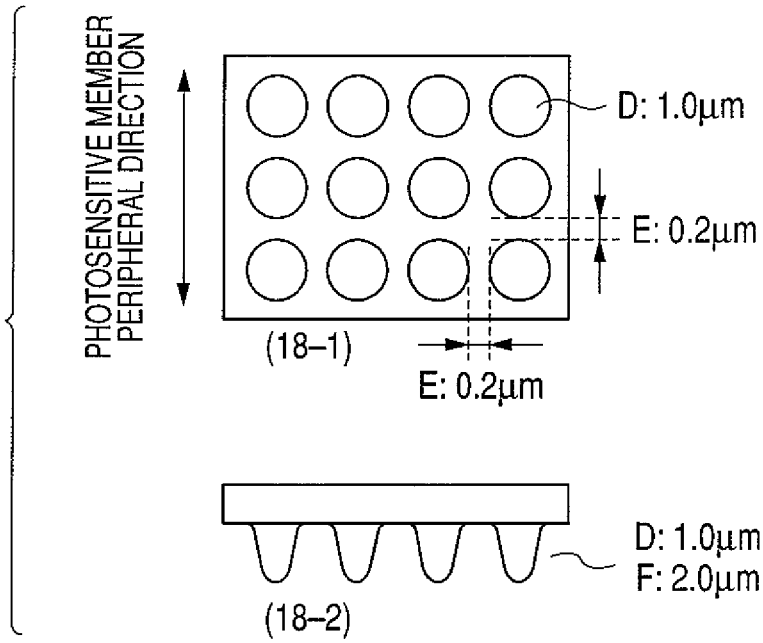
FIG. 18 is a view showing the shape of a mold used in Photosensitive Member Production Example 3.

Photosensitive Member No. 3 was obtained by carrying out surface processing in the same way as in Production Example 2 except that the mold used in Photosensitive Member Production Example 2 was changed to a hill-shaped mold shown in FIG. 18. In FIG. 18, view 18-1 shows the surface profile of the mold as viewed from its top, and view 18-2 shows the surface profile of the mold as viewed from its side. Letter symbols D, E and F stand for the longest diameter, interval and height of protrusions, respectively.

Observation of Depressed Portions Formed

Figure 19:
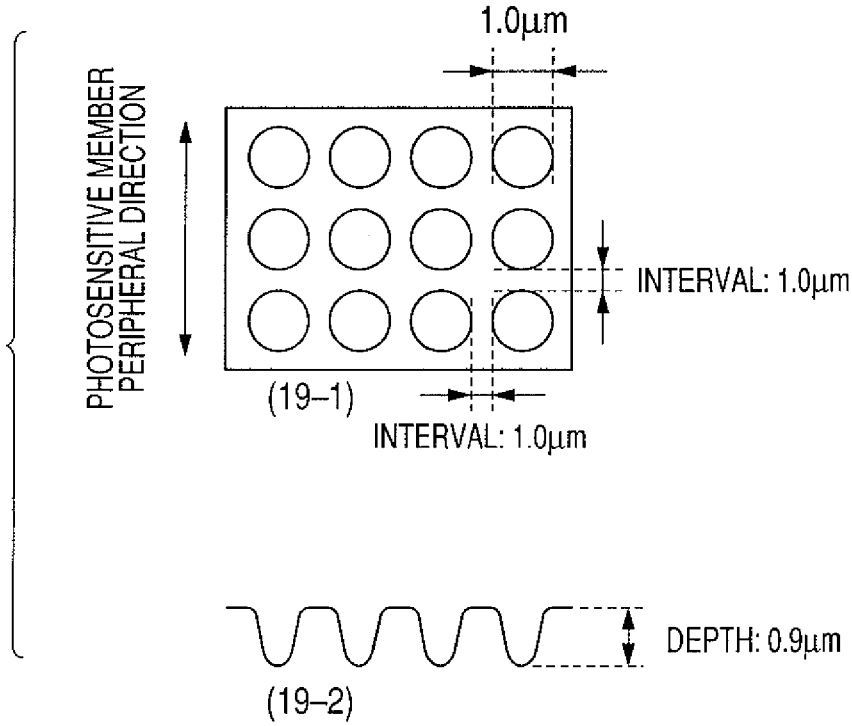
FIG. 19 is a view showing an arrangement pattern of depressed portions (partial enlarged view) of the photosensitive member outermost surface obtained according to Photosensitive Member Production Example 3.

Part of Photosensitive Member No. 3 obtained was sampled and observed with an electron microscope to ascertain that, as shown in FIG. 19, hill-corresponding depressed portions of 1.0 μm in major-axis diameter Rpc and 0.9 μm in depth Rdv were formed at intervals of 0.2 μm. In FIG. 19, view 19-1 shows how the depressed portions formed on the photosensitive member surface are arranged, and view 1-2 shows a sectional profile of the photosensitive member surface having the depressed portions. The results of surface profile measurement are shown in Table 1.

Photosensitive Member

Production Example 4

Electrophotographic Photosensitive Member No. 4 was produced in the same manner as in Photosensitive Member Production Example 1.

Formation of Depressed Portions by Mold Pressing Profile Transfer

Photosensitive Member No. 4 was obtained by carrying out surface processing in the same way as in Photosensitive Member Production Example 3 except that the mold used in Photosensitive Member Production Example 3 was so changed as to be D: 0.5 μm, E: 0.1 μm and F: 1.6 μm.

Observation of Depressed Portions Formed

Part of Photosensitive Member No. 4 obtained was picked up and observed with an electron microscope to ascertain that edged columnar depressed portions of 0.5 μm in major-axis diameter Rpc and 0.7 μm in depth Rdv were formed at intervals of 0.1 μm. The results of surface profile measurement are shown in Table 1.

Photosensitive Member

Production Example 5

Electrophotographic Photosensitive Member No. 5 was produced in the same manner as in Photosensitive Member Production Example 1.

Formation of Depressed Portions by Mold Pressing Profile Transfer

Photosensitive Member No. 5 was obtained by carrying out surface processing in the same way as in Photosensitive Member Production Example 3 except that the mold used in Photosensitive Member Production Example 3 was so changed as to be D: 0.15 μm, E: 0.03 μm and F: 1.2 μm.

Observation of Depressed Portions Formed

Part of Photosensitive Member No. 5 obtained was picked up and observed with an electron microscope to ascertain that edged columnar depressed portions of 0.15 μm in major-axis diameter Rpc and 0.5 μm in depth Rdv were formed at intervals of 0.03 μm. The results of surface profile measurement are shown in Table 1.

Photosensitive Member

Production Example 6

Electrophotographic Photosensitive Member No. 6 was produced in the same manner as in Photosensitive Member Production Example 1.

Formation of Depressed Portions by Excimer Laser

Photosensitive Member No. 6 was obtained by carrying out surface processing in the same way as in Photosensitive Member Production Example 1 except that the mask used in Photosensitive Member Production Example 1, as shown in FIG. 14, was changed to a mask made of quartz glass having a pattern in which circular transparent areas to laser light of 30 μm in diameter were arranged at intervals of 20 μm, and the mask projected area was 2.0 mm square for each irradiation. The results of surface profile measurement are shown in Table 1.

Photosensitive Member

Production Example 7

Electrophotographic Photosensitive Member No. 7 was produced in the same manner as in Photosensitive Member Production Example 1.

Formation of Depressed Portions by Excimer Laser

Photosensitive Member No. 7 was obtained by carrying out surface processing in the same way as in Photosensitive Member Production Example 6 except that the mask used in Photosensitive Member Production Example 1, as shown in FIG. 14, was changed to a mask made of quartz glass having a pattern in which circular transparent areas to laser light of 70 μm in diameter were arranged at intervals of 7 μm.

Observation of Depressed Portions Formed

The surface profile of the photosensitive member obtained was observed under magnification with a laser microscope (VK-9500, manufactured by Keyence Corporation) to ascertain that edge-free columnar depressed portions of 20.5 μm in major-axis diameter Rpc were formed at intervals of 2.1 μm. The depth Rdv of the depressed portions was 0.9 μm. The results of surface profile measurement are shown in Table 1.

Photosensitive Member

Production Example 8

Electrophotographic Photosensitive Member No. 8 was produced in the same manner as in Photosensitive Member Production Example 1.

Formation of Depressed Portions by Excimer Laser

Photosensitive Member No. 8 was obtained by carrying out surface processing in the same way as in Photosensitive Member Production Example 6 except that the mask used in Photosensitive Member Production Example 1, as shown in FIG. 14, was changed to a mask made of quartz glass having a pattern in which circular transparent areas to laser light of 100 μm in diameter were arranged at intervals of 10 μm.

Observation of Depressed Portions Formed

The surface profile of Photosensitive Member No. 8 obtained was observed under magnification with a laser microscope (VK-9500, manufactured by Keyence Corporation) to ascertain that edge-free columnar depressed portions of 29.2 μm in major-axis diameter Rpc were formed at intervals of 2.9 μm. The depth Rdv of the depressed portions was 0.9 μm. The results of surface profile measurement are shown in Table 1.

Photosensitive Member

Production Example 9

Electrophotographic Photosensitive Member No. 9 was produced in the same manner as in Photosensitive Member Production Example 1.

Formation of Depressed Portions by Mold Pressing Profile Transfer

Photosensitive Member No. 9 was obtained by carrying out surface processing in the same way as in Photosensitive Member Production Example 2 except that the mold used in Photosensitive Member Production Example 2 was so changed as to be D: 0.10 μm, E: 0.02 μm and F: 1.0 μm.

Observation of Depressed Portions Formed

Part of Photosensitive Member No. 9 obtained was picked up and observed with an electron microscope to ascertain that edged columnar depressed portions of 0.10 μm in major-axis diameter Rpc and 0.4 μm in depth Rdv were formed at intervals of 0.02 μm. The results of surface profile measurement are shown in Table 1.

Photosensitive Member

Production Example 10

Electrophotographic Photosensitive Member No. 10 was produced in the same manner as in Photosensitive Member Production Example 1.

Formation of Depressed Portions by Mold Pressing Profile Transfer

Figure 20:
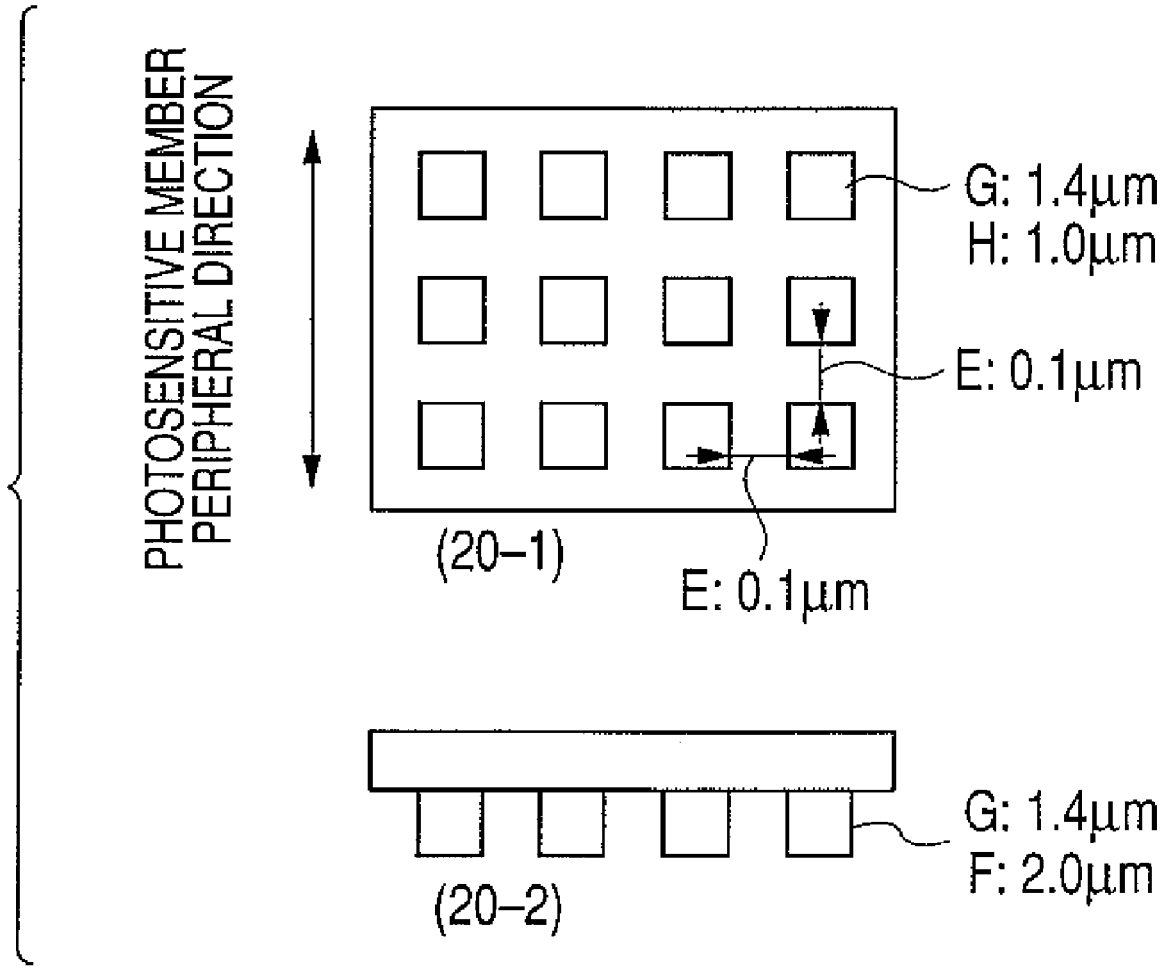
FIG. 20 is a view showing the shape of a mold used in Photosensitive Member Production Example 10.

Photosensitive Member No. 10 was obtained by carrying out surface processing in the same way as in Photosensitive Member Production Example 2 except that the mold used in Photosensitive Member Production Example 2 was changed to a mold having cubic protrusions as shown in FIG. 20. In FIG. 20, view 20-1 shows the surface profile of the mold as viewed from its top, and view 20-2 shows the surface profile of the mold as viewed from its side. Reference characters E, F, G and H stand for the interval, height, longest diameter and shortest diameter of the protrusions, respectively.

Observation of Depressed Portions Formed

Part of Photosensitive Member No. 10 obtained was picked up and observed with an electron microscope to ascertain that cubic depressed portions of 1.0 μm in minor-axis diameter Lpc, 1.4 μm in major-axis diameter Rpc and 1.0 μm in depth Rdv were formed at intervals of 0.1 μm. The results of surface profile measurement are shown in Table 1.

Photosensitive Member

Production Example 11

Electrophotographic Photosensitive Member No. 11 was produced in the same manner as in Photosensitive Member Production Example 1.

Formation of Depressed Portions by Mold Pressing Profile Transfer

Figure 21A:
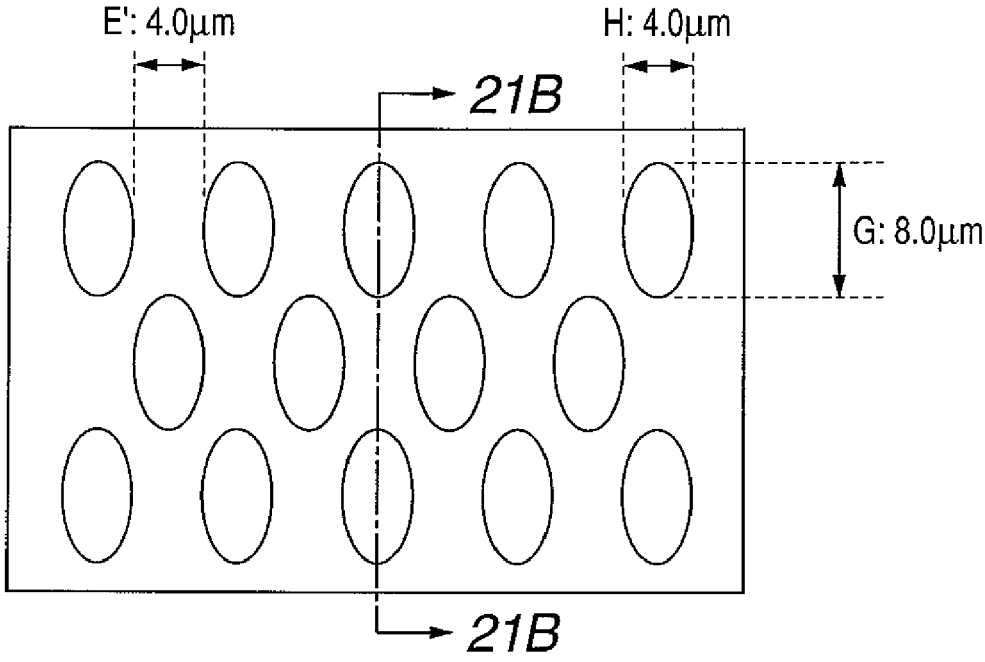
FIG. 21A is a view showing the shape of a mold used in Photosensitive Member Production Example 11.
Figure 21B:
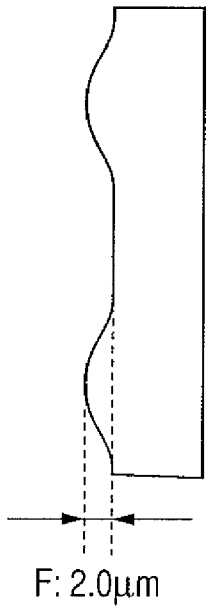
FIG. 21B is a cross-sectional view taken along the line 21B-21B in FIG. 21A.

Photosensitive Member No. 11 was obtained by carrying out surface processing in the same way as in Production Example 2 except that the mold used in Photosensitive Member Production Example 2 was changed to a hill-shaped mold shown in FIGS. 21A and 21B. FIG. 21A shows the surface profile of the mold as viewed from its top, and 21B show a sectional profile taken along the line 21B-21B in FIG. 21A. In FIGS. 21A and 21B, E', F, G and H stand for the interval, height, longest diameter and shortest diameter of protrusions, respectively.

Observation of Depressed Portions Formed

The surface profile of Photosensitive Member No. 11 obtained was observed under magnification with a laser microscope (VK-9500, manufactured by Keyence Corporation) to ascertain that hill-corresponding depressed portions of 4.0 μm in minor-axis diameter Lpc, 8.0 μm in major-axis diameter Rpc and 0.9 μm in depth Rdv were formed. The results of surface profile measurement are shown in Table 1.

Photosensitive Member

Production Example 12

Electrophotographic Photosensitive Member No. 12 was produced in the same manner as in Photosensitive Member Production Example 1.

Formation of Depressed Portions by Mold Pressing Profile Transfer

Photosensitive Member No. 12 was obtained by carrying out surface processing in the same way as in Photosensitive Member Production Example 2 except that the mold used in Photosensitive Member Production Example 2 was so changed as to be D: 3.1 μm, E: 0.6 μm and F: 1.6 μm.

Observation of Depressed Portions Formed

The surface profile of Photosensitive Member No. 12 obtained was observed under magnification with a laser microscope (VK-9500, manufactured by Keyence Corporation) to ascertain that edged columnar depressed portions of 3.1 μm in major-axis diameter Rpc and 1.5 μm in depth Rdv stood formed at intervals of 0.6 μm. The results of surface profile measurement are shown in Table 1.

Photosensitive Member

Production Example 13

Electrophotographic Photosensitive Member No. 13 was produced in the same manner as in Photosensitive Member Production Example 1.

Formation of Depressed Portions by Mold Pressing Profile Transfer

Figure 22A:
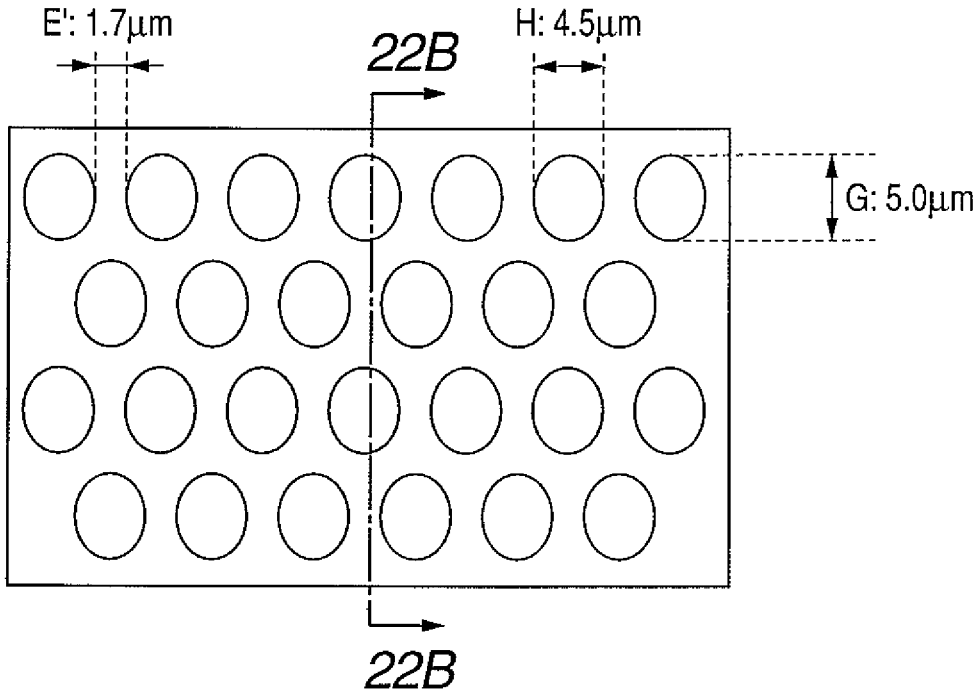
FIG. 22A is a view showing the shape of a mold used in Photosensitive Member Production Example 13.
Figure 22B:
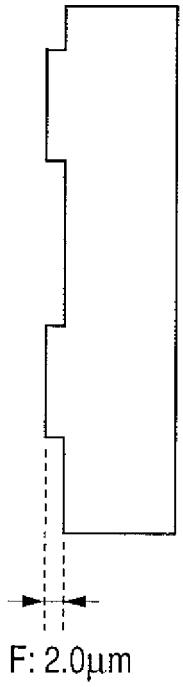
FIG. 22B is a cross-sectional view taken along the line 22B-22B in FIG. 22A.

Photosensitive Member No. 13 was obtained by carrying out surface processing in the same way as in Production Example 2 except that the mold used in Photosensitive Member Production Example 2 was changed to a mold having elliptic cylinder-shaped protrusions as shown in FIGS. 22A and 22B. FIG. 22A shows the surface profile of the mold as viewed from its top, and 22B show a sectional profile taken along the line 22B-22B in FIG. 22A. In FIGS. 22A and 22B, E', F, G and H stand for the interval, height, longest diameter and shortest diameter of the protrusions, respectively.

Observation of Depressed Portions Formed

The surface profile of Photosensitive Member No. 13 obtained was observed under magnification with a laser microscope (VK-9500, manufactured by Keyence Corporation) to ascertain that edged columnar depressed portions of 4.5 μm in minor-axis diameter Lpc, 5.0 μm in major-axis diameter Rpc and 1.2 μm in depth Rdv were formed at intervals of 0.6 μm. The results of surface profile measurement are shown in Table 1.

Photosensitive Member

Production Example 14

Electrophotographic Photosensitive Member No. 14 was produced in the same manner as in Photosensitive Member Production Example 1.

Formation of Depressed Portions by Mold Pressing Profile Transfer

Photosensitive Member No. 14 was obtained by carrying out surface processing in the same way as in Photosensitive Member Production Example 2 except that the mold used in Photosensitive Member Production Example 10 was so changed as to be H, 3.0 μm, G: 4.2 μm, E: 0.3 μm and F: 0.8 μm.

Observation of Depressed Portions Formed

The surface profile of Photosensitive Member No. 14 obtained was observed under magnification with a laser microscope (VK-9500, manufactured by Keyence Corporation) to ascertain that edged cubic depressed portions of 3.0 μm in minor-axis diameter Lpc, 4.2 μm in major-axis diameter Rpc and 0.4 μm in depth Rdv stood formed at intervals of 0.3 μm. The results of surface profile measurement are shown in Table 1.

Photosensitive Member

Production Example 15

Electrophotographic Photosensitive Member No. 15 was produced in the same manner as in Photosensitive Member Production Example 1.

Formation of Depressed Portions by Titanium Sapphire Laser

Photosensitive Member No. 15 was obtained by carrying out surface processing in the same way as in Photosensitive Member Production Example 1 except that, in the laser surface processing used in Photosensitive Member Production Example 1, the irradiation light source was changed to a regenerative amplification mode-locked Ti: sapphire laser (wavelength λ: 800 nm; pulse width: 100 fs), and the mask projected area was 1.17 mm square for each irradiation.

Observation of Depressed Portions Formed

The surface profile of Photosensitive Member No. 15 obtained was observed under magnification with a laser microscope (VK-9500, manufactured by Keyence Corporation) to ascertain that edged columnar depressed portions of 5.0 μm in major-axis diameter Rpc were formed at intervals of 1.7 μm. The depth Rdv of the depressed portions was 1.0 μm. The results of surface profile measurement are shown in Table 1.

Photosensitive Member

Production Example 16

In Production Example 1, the charge transport layer was formed using a copolymer type polyarylate resin represented by the following structural formula (4) in place of the polycarbonate resin (trade name: IUPILON Z400; available from Mitsubishi Engineering-Plastics Corporation). Thereafter, a member in which no second charge transport layer was formed was obtained as Electrophotographic Photosensitive Member No. 16.

(4)

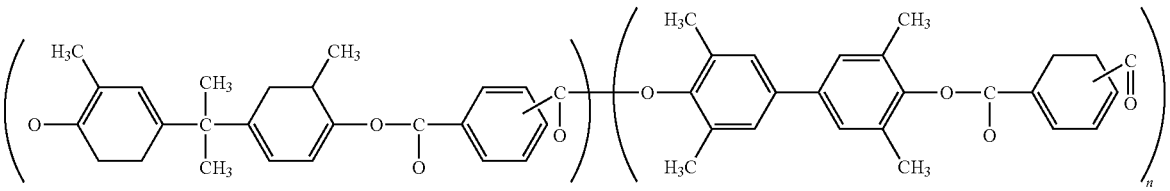

(In the formula, m and n each represent a ratio (copolymerization ratio) of repeating units in this resin. In this resin, m:n is 7:3. The form of copolymerization is a random copolymer.)

In the above polyarylate resin, the molar ratio of the terephthalic acid structure to the isophthalic acid structure (terephthalic acid structure: isophthalic acid structure) is 50:50. The resin has a weight average molecular weight (Mw) of 130,000.

Formation of Depressed Portions by Mold Pressing Profile Transfer

Photosensitive Member No. 16 was obtained by carrying out surface processing in the same way as in Photosensitive Member Production Example 2 except that the mold used in Photosensitive Member Production Example 2 was so changed as to be D: 5.0 μm, E: 1.0 μm and F: 2.5 μm, and the temperature of the electrophotographic photosensitive member surface was 150° C. during the processing.

Observation of Depressed Portions Formed

The surface profile of Photosensitive Member No. 16 obtained was observed under magnification with a laser microscope (VK-9500, manufactured by Keyence Corporation) to ascertain that edged columnar depressed portions of 5.0 μm in major-axis diameter Rpc were formed at intervals of 2.0 μm. The depth Rdv of the depressed portions was 1.0 μm. The results of surface profile measurement are shown in Table 1.

Photosensitive Member

Production Example 17

Electrophotographic Photosensitive Member No. 17 was produced in the same manner as in Photosensitive Member Production Example 1.

Formation of Depressed Portions by Mold Pressing Profile Transfer

Photosensitive Member No. 17 was obtained by carrying out surface processing in the same way as in Photosensitive Member Production Example 2 except that the mold used in Photosensitive Member Production Example 2 was so changed as to be D: 5.0 μm, E: 1.0 μm and F: 3.0 μm, and the electrophotographic photosensitive member and the mold were so temperature-controlled as to be 125° C. at the time of surface processing and the pressure of 2.5 MPa (25 kg/cm$^2$) was applied.

Observation of Depressed Portions Formed

The surface profile of Photosensitive Member No. 17 obtained was observed under magnification with a laser microscope (VK-9500, manufactured by Keyence Corporation) to ascertain that edge-free dimple-shaped depressed portions of 4.2 μm in major-axis diameter Rpc and 1.0 μm in depth Rdv were formed at intervals of 1.0 μm. The results of surface profile measurement are shown in Table 1.

Photosensitive Member

Production Example 18

Electrophotographic Photosensitive Member No. 18 was produced in the same manner as in Photosensitive Member Production Example 1.

Formation of Depressed Portions by Mold Pressing Profile Transfer

Photosensitive Member No. 18 was obtained by carrying out surface processing in the same way as in Photosensitive Member Production Example 2 except that the mold used in Photosensitive Member Production Example 2 was so changed as to be D: 2.4 μm, E: 0.4 μm and F: 1.0 μm.

Observation of Depressed Portions Formed

The surface profile of the photosensitive member obtained was observed under magnification with a laser microscope (VK-9500, manufactured by Keyence Corporation) to ascertain that edged columnar depressed portions of 2.4 μm in major-axis diameter Rpc and 0.8 μm in depth Rdv were formed at intervals of 0.4 μm. The results of surface profile measurement are shown in Table 1.

(2) Production of Non-magnetic Toner

Non-magnetic Toner

Production Example 1

In 405 parts of ion exchange water, 250 parts of a 0.1N—$Na_3PO_4$ aqueous solution was introduced, followed by heating to 60° C. Thereafter, to the resultant mixture, 40.0 parts of a 1.07 N—$CaCl_2$ aqueous solution was slowly added to obtain an aqueous medium containing calcium phosphate.

Meanwhile, materials formulated as shown below were uniformly dispersed and mixed using an attritor (manufactured by Mitsui Miike Engineering Corporation) to prepare a monomer composition.

| | |
|---|---|
| Styrene | 80 parts |
| n-Butyl acrylate | 20 parts |
| Divinylbenzene | 0.2 part |
| Saturated polyester resin (a polycondensation product of propylene oxide modified bisphenol A with isophthalic acid; Tg: 70° C.; Mw: 41,000; acid value: 15 mgKOH/g; hydroxyl value: 25) | 4.0 parts |
| Negatively charging charge control agent (an Al compound of di-tertiary-butylsalicylic acid) | 1 part |
| C.I. Pigment Blue 15:3 | 6.0 parts |

This monomer composition was heated to a temperature of 60° C., and 12 parts of an ester wax composed chiefly of behenyl behenate (maximum endothermic peak at the time of heating and measurement in DSC: 72° C.) was added thereto and mixed. To the mixture obtained, 3 parts of a polymerization initiator 2,2'-azobis(2,4-dimethylvaleronitrile) [$t_{1/2}$ (half life): 140 minutes; under conditions of 60° C.) was dissolved to prepare a polymerizable monomer composition.

The polymerizable monomer composition was introduced into the above aqueous medium, followed by stirring for 15 minutes at 60.5° C. in an atmosphere of $N_2$, using a TK-type homomixer (manufactured by Tokushu Kika Kogyo Co., Ltd.) at 10,000 rpm to carry out granulation. Thereafter, the granulated product was allowed to react at a temperature of 60.5° C. for 6 hours while being stirred with a paddle stirring blade. Thereafter, the liquid temperature was raised to 80° C. and the stirring was continued for further 4 hours. After the reaction was completed, distillation was carried out at a temperature of 80° C. for 3 hours. Thereafter, the resultant suspension was cooled, and hydrochloric acid was added thereto to dissolve the calcium phosphate, followed by filtration and then water washing to obtain wet toner particles.

Next, the above particles were dried at 40° C. for 12 hours to obtain colored particles (toner particles).

100 parts of the toner particles obtained, and 1.0 part of hydrophobic fine silica particles (treated with 10% by mass of silicone oil; BET specific surface area: 130 m$^2$/g) having a primary particle diameter of 12 nm and 1.5 parts of hydrophobic fine silica particles (treated with 5% by mass of silicone oil) having a primary particle diameter of 110 nm, were mixed by means of Henschel mixer (manufactured by Mitsui Miike Engineering Corporation) to obtain Non-magnetic Toner (cyan toner) 1. Physical properties of Non-magnetic Toner 1 are shown in Table 2. In this Non-magnetic Toner Production Example, the maximum number-average particle diameter (Dt) among the number-average particle diameters of the respective types of inorganic fine powders contained in the toner is 110 nm.

Non-magnetic Toner

Production Example 2

A polymerizable monomer composition was prepared in the same manner as in Non-magnetic Toner Production Example 1 except that, in place of 6.0 parts of C.I. Pigment Blue 15:3, 8.0 parts of C.I. Pigment Red 122 was used. This polymerizable monomer composition was introduced into the same aqueous medium as in Toner Production Example 1, followed by stirring for 15 minutes at 62° C. in an atmosphere of $N_2$, using a TK-type homomixer (manufactured by Tokushu Kika Kogyo Co., Ltd.) at 10,000 rpm to carry out granulation. Thereafter, the granulated product was allowed to react at 62° C. for 6 hours while being stirred with a paddle stirring blade. Thereafter, the liquid temperature was raised to 80° C. and the stirring was continued for further 4 hours. After the reaction was completed, distillation was carried out at 80° C. for 3 hours. Thereafter, the resultant suspension was cooled, and hydrochloric acid was added thereto to dissolve the calcium phosphate, followed by filtration and then water washing to obtain wet colored particles.

Next, the above particles were dried at 40° C. for 12 hours to obtain colored particles (toner particles).

100 parts of the toner particles obtained, and 1.0 part of hydrophobic fine silica particles (treated with 8% by mass of hexamethyldisilazane and thereafter treated with 2% by mass of silicone oil; BET specific surface area: 130 $m^2/g$) having a primary particle diameter of 12 nm and 1.5 parts of hydrophobic fine silica particles (treated with 5% by mass of silicone oil) having a primary particle diameter of 110 nm, were mixed by means of Henschel mixer (manufactured by Mitsui Miike Engineering Corporation) to obtain Non-magnetic Toner (magenta toner) 2. Physical properties of Non-magnetic Toner 2 are shown in Table 2.

Non-magnetic Toner

Production Example 3

A polymerizable monomer composition was prepared in the same manner as in Non-magnetic Toner Production Example 1 except that, in place of 6.0 parts of C.I. Pigment Blue 15:3, 8.0 parts of C.I. Pigment Yellow 17 was used. This polymerizable monomer composition was introduced into the same aqueous medium as in Toner Production Example 1, followed by stirring for 15 minutes at 58° C. in an atmosphere of $N_2$, using a TK-type homomixer (manufactured by Tokushu Kika Kogyo Co., Ltd.) at 10,000 rpm to carry out granulation. Thereafter, the granulated product was allowed to react at 58° C. for 6 hours while being stirred with a paddle stirring blade. Thereafter, the liquid temperature was raised to 80° C. and the stirring was continued for further 4 hours. After the reaction was completed, distillation was further carried out at 80° C. for 3 hours. Thereafter, the resultant suspension was cooled, and hydrochloric acid was added thereto to dissolve the calcium phosphate, followed by filtration and then water washing to obtain wet colored particles.

Next, the above particles were dried at 40° C. for 12 hours to obtain colored particles (toner particles).

100 parts of the toner particles obtained, and 1.0 part of hydrophobic fine silica particles (treated with 5% by mass of hexamethyldisilazane; BET specific surface area: 120 $m^2/g$) having a primary particle diameter of 20 nm and 1.5 parts of hydrophobic fine silica particles (treated with 5% by mass of silicone oil) having a primary particle diameter of 110 nm, were mixed by means of Henschel mixer (manufactured by Mitsui Miike Engineering Corporation) to obtain Non-magnetic Toner (yellow toner) 3. Physical properties of Non-magnetic Toner 3 are shown in Table 2.

Non-magnetic Toner

Production Example 4

| | |
|---|---|
| Styrene/n-butyl acrylate copolymer (mass ratio: 85/15; Mw: 330,000) | 80 parts |
| Saturated polyester resin (a polycondensation product of propylene oxide modified bisphenol A with isophthalic acid; Tg: 56° C.; Mw: 18,000; acid value: 8; hydroxyl value: 13) | 4.5 parts |
| Negative charge control agent (an Al compound of di-tertiary-butylsalicylic acid) | 3 parts |
| C.I. Pigment Blue 15:3 | 7 parts |
| Ester wax composed chiefly of behenyl behenate (maximum endothermic peak at the time of heating and measurement in DSC: 72° C.) | 5 parts |

The above materials were mixed by means of a blender, melt-kneaded by means of a twin-screw extruder heated to 110° C., and cooled. The kneaded product cooled was coarsely crushed by means of a hammer mill (manufactured by Hosokawa Micron Corporation), and then was finely pulverized using a pulverizing mill of an air jet system whose impact plate was so adjusted as to be at an angle of 90 degrees with respect to the direction of impact. The finely pulverized product thus obtained was air-classified to obtain toner particles. Thereafter, the toner particles were subjected to spherical treatment by means of a batch type impact surface treating unit (treatment temperature: 40° C.; rotary treating blade peripheral speed: 75 m/sec; treatment time: 2.5 minutes).

Next, in 100 parts of the spherical toner particles obtained, 1.0 part of hydrophobic fine silica particles (treated with 10% by mass of silicone oil; BET specific surface area: 130 $m^2/g$) having a primary particle diameter of 12 nm and 1.5 parts of hydrophobic fine silica particles (treated with 5% by mass of silicone oil) having a primary particle diameter of 110 nm were mixed by means of Henschel mixer (manufactured by Mitsui Miike Engineering Corporation) to obtain Non-magnetic Toner (cyan toner) 4. Physical properties of Non-magnetic Toner 4 are shown in Table 2.

Non-magnetic Toner

Production Example 5

Non-magnetic Toner (cyan toner) 5 was obtained in the same manner as in Non-magnetic Toner Production Example 4 except that the conditions for spherical treatment in the batch type impact surface treating unit after air classification were relaxed (treatment temperature: 40° C.; rotary treating blade peripheral speed: 30 m/sec; treatment time: 2.0 minutes). Physical properties of Non-magnetic Toner 5 are shown in Table 2.

Non-magnetic Toner

Production Example 6

Non-magnetic Toner (cyan toner) 6 was obtained in the same manner as in Non-magnetic Toner Production Example 4 except that the conditions for spherical treatment in the batch type impact surface treating unit after air classification were further relaxed (treatment temperature: 40° C.; rotary treating blade peripheral speed: 25 m/sec; treatment time: 1.0 minutes). Physical properties of Non-magnetic Toner 6 are shown in Table 2.

Non-magnetic Toner

Production Example 7

Non-magnetic Toner (cyan toner) 7 was obtained in the same manner as in Non-magnetic Toner Production Example 4 except that the coarsely crushed product for toner was finely pulverized using a jet mill (manufactured by Nippon Pneumatic Industries Co.) and the spherical treatment was not carried out. Physical properties of Non-magnetic Toner 7 are shown in Table 2.

Non-magnetic Toner

Production Example 8

Non-magnetic Toner (cyan toner) 8 was obtained in the same manner as in Non-magnetic Toner Production Example 1 except that the colored particles (toner particles) having been dried were classified using an air classifier (ELBOW JET LABO EJ-L3, manufactured by Nittetsu Mining Co., Ltd.) to adjust the particle size. Physical properties of Non-magnetic Toner 8 are shown in Table 2.

Non-magnetic Toner

Production Example 9

Non-magnetic Toner (cyan toner) 9 was obtained in the same manner as in Non-magnetic Toner Production Example 4 except that, in place of 5 parts of the ester wax composed chiefly of behenyl behenate, 5 parts of Fischer-Tropsch wax (maximum endothermic peak at the time of heating and measurement in DSC: 105° C.) was used. Physical properties of Non-magnetic Toner 9 are shown in Table 2.

Non-magnetic Toner

Production Example 10

Non-magnetic Toner (cyan toner) 10 was obtained in the same manner as in Non-magnetic Toner Production Example 4 except that, in place of 5 parts of the ester wax composed chiefly of behenyl behenate, 5 parts of ester wax composed chiefly of stearyl stearate (maximum endothermic peak at the time of heating and measurement in DSC: 65° C.) was used. Physical properties of Non-magnetic Toner 10 are shown in Table 2.

Non-magnetic Toner

Production Example 11

Non-magnetic Toner (cyan toner) 11 was obtained in the same manner as in Non-magnetic Toner Production Example 4 except that, in place of 5 parts of the ester wax composed chiefly of behenyl behenate, 5 parts of polyethylene wax (maximum endothermic peak at the time of heating and measurement in DSC: 108° C.) was used. Physical properties of Non-magnetic Toner 11 are shown in Table 2.

Non-magnetic Toner

Production Example 12

Non-magnetic Toner (cyan toner) 12 was obtained in the same manner as in Non-magnetic Toner Production Example 4 except that, in place of 5 parts of the ester wax composed chiefly of behenyl behenate, 5 parts of purified normal paraffin wax (maximum endothermic peak at the time of heating and measurement in DSC: 60° C.) was used. Physical properties of Non-magnetic Toner 11 are shown in Table 2.

Non-magnetic Toner

Production Example 13

| | |
|---|---|
| Styrene/n-butyl acrylate copolymer (mass ratio: 85/15; Mw: 330,000) | 84.5 parts |
| Saturated polyester resin (a polycondensation product of propylene oxide modified bisphenol A with isophthalic acid; Tg: 56° C.; Mw: 18,000; acid value: 8; hydroxyl value: 13) | 2.5 parts |
| Negative charge control agent (an Al compound of di-tertiary-butylsalicylic acid) | 3 parts |
| Carbon black | 7.0 parts |
| Purified normal paraffin wax (maximum endothermic peak at the time of heating and measurement in DSC: 74° C.) | 5 parts |

The above materials were mixed by means of a blender, melt-kneaded by means of a twin-screw extruder heated to 110° C., and cooled. The kneaded product cooled was coarsely crushed by means of a hammer mill (manufactured by Hosokawa Micron Corporation), and then was finely pulverized using a fine pulverizing mill of an air jet system whose impact plate was so adjusted as to be at an angle of 90 degrees with respect to the direction of impact. The finely pulverized product thus obtained was air-classified to obtain toner particles. Thereafter, the toner particles were subjected to spherical treatment by means of a batch type impact surface treating unit (treatment temperature: 40° C.; rotary treating blade peripheral speed: 75 m/sec; treatment time: 3 minutes).

Next, to 100 parts of the spherical toner particles obtained, 1.0 part of fine rutile titanium oxide particles (primary particle diameter: 35 nm; treated with 10% by mass of an isobutyl silane coupling agent), 0.7 part of hydrophobic fine silica particles (treated with 10% by mass of silicone oil) having a primary particle diameter of 15 nm and 2.5 parts of hydrophobic fine silica particles (treated with 5% by mass of silicone oil) having a primary particle diameter of 110 nm were externally added by means of Henschel mixer to obtain Non-magnetic Toner (black toner) 13. Physical properties of Non-magnetic Toner 13 are shown in Table 2.

Non-magnetic Toner

Production Example 14

Non-magnetic Toner (cyan toner) 14 was obtained in the same manner as in Non-magnetic Toner Production Example 1 except that, in place of 7.0 parts of the carbon black, 7.0 parts of C.I. Pigment Blue 15:3 was used. Physical properties of Non-magnetic Toner 14 are shown in Table 2.

Production of Carrier

| Production of Carrier 1 | |
|---|---|
| Phenol (hydroxybenzene) | 50 parts |
| 37% by mass formalin aqueous solution | 80 parts |
| Water | 50 parts |
| Fine magnetite particles surface-treated with silane type coupling agent (KBM403, available from Shin-Etsu Chemical Co., Ltd.) | 320 parts |
| Fine $\alpha$-$Fe_2O_3$ particles surface-treated with silane type coupling agent (KBM403, available from Shin-Etsu Chemical Co., Ltd.) | 80 parts |
| 25% by mass ammonia water | 15 parts |

The above materials were put into a four-necked flask. Temperature was raised to 85° C. over a period of 50 minutes with stirring and mixing. At this temperature, the reaction was carried out for 120 minutes to effect curing. Thereafter, the reaction mixture was cooled to 30° C., and 500 parts of water was added thereto. Then, the supernatant formed was removed, and the precipitate washed with water, followed by air drying. Subsequently, the air-dried product was further dried at 160° C. for 24 hours under reduced pressure (665 Pa 5 mmHg) to obtain magnetic carrier cores (A) having phenolic resin as a binder resin.

The surfaces of the magnetic carrier cores (A) thus obtained were coated with a 3% by mass $\gamma$-aminopropyltrimethoxysilane solution in methanol. During the coating, the methanol was evaporated while continuously applying shear stress to the magnetic carrier cores (A).

While stirring at 50° C. the magnetic carrier cores (A) in a treating machine having been treated with the silane coupling agent, a silicone resin SR2410 (available from Dow Corning Toray Co., Ltd.) was so diluted with toluene as to have 20% of silicone resin solid content and added under reduced pressure to apply 0.5% by mass resin coating to the magnetic carrier cores.

Subsequently, after the toluene was evaporated with stirring for 2 hours in an atmosphere of nitrogen gas, heat treatment was carried out at 140° C. for 2 hours in an atmosphere of nitrogen gas. After agglomerates were disintegrated, coarse particles of 200 mesh (75 μm sieve opening) or more were removed to obtain Carrier 1.

Carrier 1 thus obtained had a volume-average particle diameter of 35 μm and a true specific gravity of 3.7 g/cm$^3$.

Example 1

Non-magnetic Toner 1 and Carrier 1 were blended in a toner concentration of 8% to prepare Two-component Developer No. 1.

Next, Electrophotographic Photosensitive Member 1 was fitted to a modified machine (modified into a negative charging type) of an electrophotographic copying machine iRC6800, manufactured by CANON INC., to make an evaluation in the following way.

First, in an environment of temperature 23° C./humidity 50% RH, conditions of potential were set so that the electrophotographic photosensitive member had a dark area potential (Vd) of −700 V and a light area potential (Vl) of −200 V, and the initial-stage potential of the electrophotographic photosensitive member was adjusted.

Next, a cleaning blade made of polyurethane rubber was so set as to be at a contact angle of 26 degrees with respect to the electrophotographic photosensitive member surface and at a contact pressure of 0.294 N/cm (30 g/cm).

Thereafter, using the above Developer No. 1, one line/one space images were reproduced at a reproduction resolution of 600 dpi, and then magnified 100 times with an optical microscope to evaluate line reproducibility according to the following criteria. The results of evaluation are as shown in Table 3.

A: Very clear.

B: Clear.

C: Some of lines are unclear.

D: Lines are difficult to distinguish.

Next, a 5,000-sheet image reproduction durability test was conducted under conditions of A4 paper size and monochrome 10-sheet intermittent reproduction. In this case, a test chart having a print percentage of 5% was used only for the first sheet among the 10-sheet intermittent reproduction. On the other 9 sheets, solid white images were formed. After the durability test was finished, a halftone image as a test image was reproduced, and any defects on the images reproduced were detected to make an evaluation according to the following criteria. The results of evaluation are as shown in Table 3.

A: Good.

B: Image defects due to very slight melt adhesion of toner are seen.

C: Image defects due to slight melt adhesion of toner are seen.

D: Image defects due to melt adhesion of toner are seen.

E: Contamination due to faulty fixing is seen.

Transfer efficiency was measured. The results of evaluation are as shown in Table 3.

The cleaning blade after the durability test was observed to detect any defects such as edges chipped off or gouged, to make an evaluation according to the following criteria.

A: Good.

B: Some part has been chipped off.

C: Some part has been gouged.

From drive current value A at the initial stage and drive current value B after the 50,000-sheet durability test, of a motor for rotating the electrophotographic photosensitive member, the value of B/A was found, and this value was regarded as relative torque rise rate. The torque rise rate found is shown in Table 3.

A durability test in a high-temperature and high-humidity environment (30° C./80% RH) was further conducted in the same way as in the above, and any defects attributable to smeared images on the images reproduced were detected to evaluate dot reproducibility after the durability test according to the following criteria. The results of evaluation are as shown in Table 3.

A: Good.

B: Some of dot outlines are unclear.

C: Dot outlines are unclear as a whole.

In the image forming method of this Example, both good line reproducibility in high-density test chart reproduction and good cleaning performance in low-density test chart reproduction were achieved. The torque was kept from rising during the durability test, so that no image defect came about throughout the durability test. Further, the dot reproducibility was good in the high-temperature and high-humidity environment.

Example 2

Image reproduction tests were conducted in the same way as in Example 1 except that the photosensitive member and developer used in the image reproduction were changed as shown in Table 3. Also, evaluation was made in the same way as in Example 1.

In the image forming method of this Example, good cleaning performance was shown also in low-density test chart reproduction, but the line reproducibility in high-density test chart reproduction was inferior to that in Example 1. However, the torque was kept from rising during the durability test, so that no image defect came about throughout the durability test. The dot reproducibility was also good in the high-temperature and high-humidity environment. The results of evaluation are shown in Table 3.

Examples 3 to 22

Image reproduction tests were conducted in the same way as in Example 1 except that the photosensitive member and developer used in the image reproduction were changed as shown in Table 3. Also, evaluation was made in the same way as in Example 1.

Figure 23:
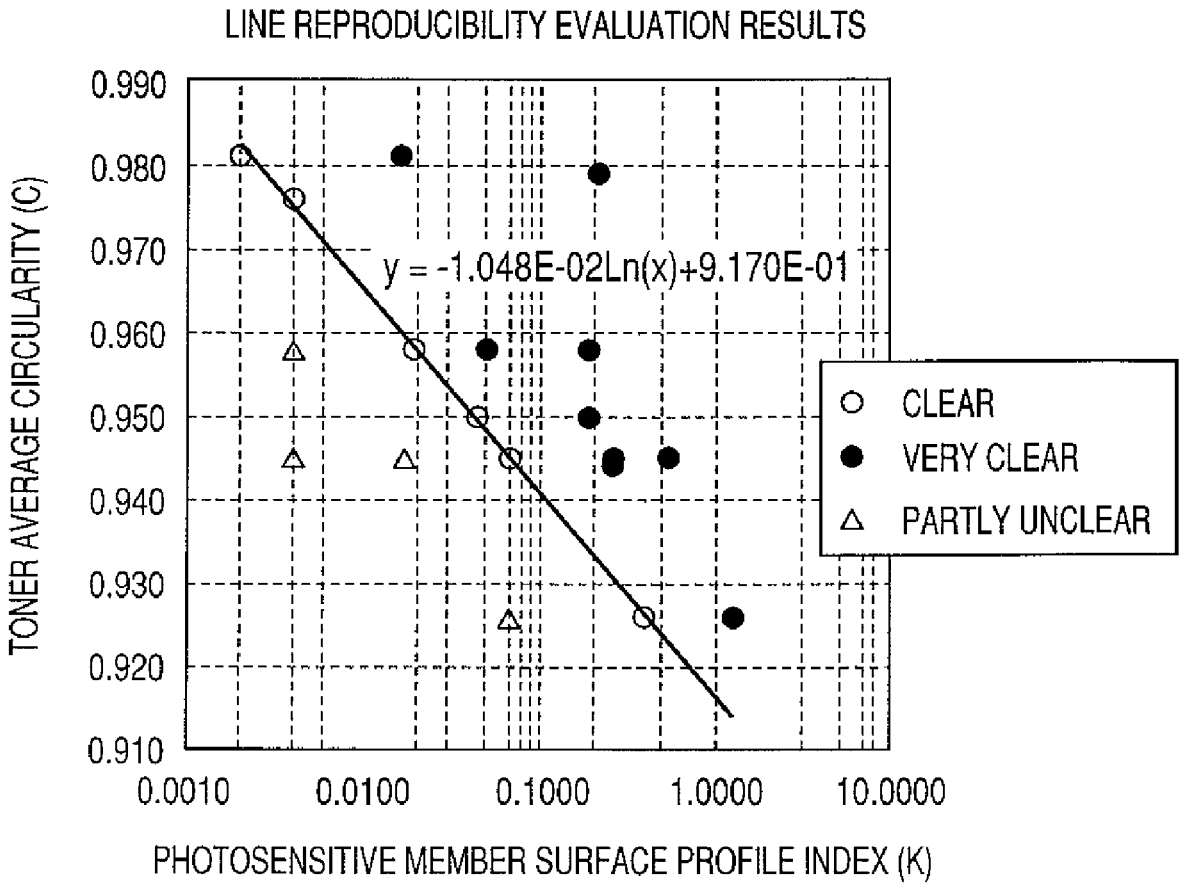
FIG. 23 is a graph showing the correlation between the photosensitive member surface profile index and the toner average circularity in the evaluation of line reproducibility.

In the image forming method of these Examples, the line reproducibility in high-density test chart reproduction was seen to be insufficient in some cases. However, in all cases, good cleaning performance was shown in low-density test chart reproduction. The results of evaluation are shown in Table 3. A graph in which the photosensitive member surface profile index K ($K=\tan^{-1}((Epc-Epch)/Edv)/Epc$ is plotted as abscissa and the toner average circularity as ordinate to show the results of evaluation of the line reproducibility in high-density test chart reproduction, is shown in FIG. 23.

Comparative Examples 1 to 9

Image reproduction tests were conducted in the same way as in Example 1 except that the photosensitive member and developer used in the image reproduction were changed as shown in Table 3.

In the image forming method of these Comparative Examples, the cleaning performance on the photosensitive member was inferior and the torque rose during the durability test, so that image defects were seen to come about at the end of the durability test. The dot reproducibility was not good in some cases in the high-temperature and high-humidity environment. The results of evaluation are shown in Table 3.

TABLE 1

| Photo-sensitive Member No. | Lpc (μm) | Rpc (μm) | Edv (μm) | Sdv ($\mu m^2$) | Epc (μm) | Epch (μm) | Number | Area percentage (%) | K |
|---|---|---|---|---|---|---|---|---|---|
| 1 | 6.0 | 6.0 | 1 | 5.90 | 6.00 | 5.9 | 156 | 43 | 0.0166 |
| 2 | 5.0 | 5.0 | 1.0 | 5.00 | 5.00 | 4.98 | 278 | 55 | 0.0040 |
| 3 | 1.0 | 1.0 | 0.9 | 0.72 | 1.0 | 0.8 | 6,944 | 40 | 0.2187 |
| 4 | 0.5 | 0.5 | 0.7 | 0.21 | 0.5 | 0.3 | 27,776 | 52 | 0.5566 |
| 5 | 0.15 | 0.15 | 0.5 | 0.03 | 0.15 | 0.05 | 308,622 | 55 | 1.3160 |
| 6 | 8.6 | 8.6 | 0.9 | 5.85 | 8.6 | 6.5 | 48 | 27 | 0.1356 |
| 7 | 20.5 | 20.5 | 0.9 | 16.92 | 20.5 | 18.8 | 20 | 65 | 0.0529 |
| 8 | 29.2 | 29.2 | 0.9 | 23.40 | 29.2 | 26 | 10 | 65 | 0.0444 |
| 9 | 0.10 | 0.10 | 0.4 | 0.04 | 0.1 | 0.09 | 694,400 | 55 | 0.2499 |
| 10 | 1.0 | 1.4 | 1.0 | 1.40 | 1.0 | 0.93 | 8,264 | 83 | 0.0699 |
| 11 | 4.0 | 8.0 | 1.0 | 3.90 | 4 | 2 | 156 | 43 | 0.2768 |
| 12 | 3.1 | 3.1 | 1.5 | 4.65 | 3.1 | 3.01 | 730 | 55 | 0.0193 |
| 13 | 4.5 | 5.0 | 1.2 | 6.00 | 4.5 | 4.29 | 296 | 53 | 0.0385 |
| 14 | 3.0 | 4.2 | 0.4 | 1.68 | 2.00 | 1.58 | 918 | 83 | 0.4049 |
| 15 | 5.0 | 5.0 | 1.0 | 5.00 | 5.0 | 4.98 | 204 | 43 | 0.0040 |
| 16 | 5.0 | 5.0 | 2 | 10.00 | 5.00 | 4.98 | 278 | 55 | 0.0020 |
| 17 | 4.2 | 4.2 | 1.2 | 3.53 | 4.2 | 2.94 | 278 | 46 | 0.1928 |
| 18 | 2.4 | 2.4 | 0.8 | 1.84 | 2.4 | 2.3 | 279 | 58 | 0.0518 |

TABLE 2

| Toner No. | Weight average particle diameter (μm) | Standard deviation of particle size distribution of toner | Average circularity | Shape factors SF-1 | Shape factors SF-2 | Endothermic temperature of maximum endothermic peak (° C.) |
|---|---|---|---|---|---|---|
| 1 | 6.7 | 1.2 | 0.981 | 115 | 113 | 72 |
| 2 | 6.8 | 1.2 | 0.976 | 120 | 115 | 72 |
| 3 | 6.7 | 1.2 | 0.979 | 117 | 114 | 72 |
| 4 | 7.1 | 2.1 | 0.945 | 150 | 130 | 72 |
| 5 | 7.1 | 2.1 | 0.926 | 155 | 138 | 72 |
| 6(*) | 7.2 | 2.2 | 0.921 | 165 | 144 | 72 |
| 7(*) | 7.2 | 2.2 | 0.911 | 171 | 151 | 72 |
| 8(*) | 6.7 | 1.2 | 0.996 | 105 | 104 | 72 |

TABLE 2-continued

| Toner No. | Weight average particle diameter (μm) | Standard deviation of particle size distribution of toner | Average circularity | Shape factors SF-1 | Shape factors SF-2 | Endothermic temperature of maximum endothermic peak (° C.) |
|---|---|---|---|---|---|---|
| 9 | 7.1 | 2.1 | 0.944 | 150 | 131 | 105 |
| 10 | 7.1 | 2.1 | 0.945 | 150 | 129 | 65 |
| 11 | 7.1 | 2.1 | 0.944 | 151 | 131 | 108 |
| 12 | 7.1 | 2.1 | 0.946 | 149 | 129 | 60 |
| 13 | 5.6 | 1.7 | 0.958 | 145 | 127 | 74 |
| 14 | 6.2 | 1.9 | 0.950 | 149 | 128 | 74 |

(*)Comparative Example

TABLE 3

| | Photo-sensitive member No. | Toner No. | Initial stage evaluation: Line reproducibility | Evaluation after 5,000-sheet running*: Image/blade edge | Evaluation after 5,000-sheet running*: Transfer efficiency | Evaluation after 50,000-sheet running*: Torque rise rate | Evaluation after 50,000-sheet running*: Dot reproducibility | Evaluation after 50,000-sheet running*: Image/blade edge |
|---|---|---|---|---|---|---|---|---|
| Example: | | | | | | | | |
| 1 | 1 | 1 | A | A/A | 95%< | 1.1 | A | B/A |
| 2 | 2 | 2 | B | A/A | 95%< | 1.1 | A | A/A |
| 3 | 3 | 3 | A | A/A | 95%< | 1.2 | A | B/A |
| 4 | 4 | 4 | A | A/A | 95%< | 1.2 | A | B/A |
| 5 | 5 | 5 | A | A/A | 95%< | 1.2 | B | B/B |
| 6 | 10 | 4 | B | A/A | 95%< | 1.2 | A | B/A |
| 7 | 11 | 4 | A | A/A | 95%< | 1.1 | B | A/A |
| 8 | 12 | 13 | B | A/A | 95%< | 1.1 | A | A/A |
| 9 | 13 | 14 | B | A/A | 95%< | 1.1 | A | A/A |
| 10 | 14 | 5 | B | A/A | 95%< | 1.1 | A | A/A |
| 11 | 11 | 9 | A | A/A | 95%< | 1.1 | B | A/A |
| 12 | 11 | 10 | A | A/A | 95%< | 1.1 | B | A/A |
| 13 | 16 | 1 | B | A/A | 95%< | 1.1 | A | A/A |
| 14 | 17 | 14 | A | A/A | 95%< | 1.1 | A | A/A |
| 15 | 17 | 13 | A | A/A | 95%< | 1.2 | A | B/A |
| 16 | 12 | 13 | A | A/A | 95% | 1.3 | A | B/A |
| 17 | 10 | 5 | C | A/A | 94% | 1.3 | A | B/A |
| 18 | 12 | 4 | C | A/A | 95% | 1.1 | A | B/A |
| 19 | 2 | 13 | C | A/A | 95% | 1.1 | A | B/A |
| 20 | 15 | 4 | C | A/A | 95% | 1.1 | A | B/A |
| 21 | 7 | 11 | B | E/A | 95%< | 1.1 | B | E/A |
| 22 | 7 | 12 | A | A/A | 95% | 1.2 | B | B/A |

TABLE 3-continued

| | | | Initial stage evaluation | Evaluation after 5,000-sheet running* | | Evaluation after 50,000-sheet running* | | |
|---|---|---|---|---|---|---|---|---|
| | Photo-sensitive member No. | Toner No. | Line reproducibility | Image/ blade edge | Transfer efficiency | Torque rise rate | Dot reproducibility | Image/ blade edge |
| Comparative Example: | | | | | | | | |
| 1 | 6 | 4 | B | B/A | 93% | 1.9 | B | C/B |
| 2 | 7 | 2 | A | C/B | 87% | 2.8 | C | D/B |
| 3 | 8 | 2 | A | D/C | 90% | 2.3 | C | D/B |
| 4 | 9 | 4 | B | B/A | 94% | 1.3 | B | C/B |
| 5 | 2 | 6 | D | B/A | 93% | 1.3 | B | C/B |
| 6 | 2 | 7 | D | B/A | 92% | 1.4 | B | C/B |
| 7 | 2 | 8 | A | B/A | 93% | 1.3 | B | C/B |
| 8 | 14 | 7 | D | B/A | 93% | 1.3 | B | C/B |
| 9 | 5 | 6 | B | B/A | 93% | 1.3 | C | C/B |

running*: durability test

This application claims priorities from Japanese Patent Applications No. 2006-022899, No. 2006-022898, No. 2006-022896 and No. 2006-022900 filed On Jan. 31, 2006 and Japanese Patent Application No. 2007-016219 filed on Jan. 26, 2007, the contents of which are incorporated hereinto by reference.

What is claimed is:

1. An image forming method comprising:

a charging step of charging a photosensitive member for holding thereon an electrostatic latent image;

an exposure step of forming an electrostatic latent image on the photosensitive member by image wise exposure;

a developing step of developing the electrostatic latent image with a toner a developing device has, to form a toner image; and a transfer step of transferring to a transfer material the toner image formed on the surface of the photosensitive member;

wherein the toner has toner particles containing at least a binder resin and a colorant, and inorganic fine powder;

the photosensitive member has on its surface a plurality of depressed portions which are independent of one another, and an average minor-axis diameter Lpc derived from minor-axis diameters of respective openings of all the depressed portions on the surface, satisfying the following expression (1):

$$Dg<Lpc<Dt \quad (1)$$

where Dt represents a weight-average particle diameter of the toner, and Dg represents a maximum number-average particle diameter among number-average particle diameters of one or two or more types of inorganic fine powder; and the toner has an average circularity of 0.925 or more and 0.995 or less.

2. The image forming method according to claim 1, wherein a shape factor SF-1 of the toner is $100<SF\text{-}1\leqq 160$, a shape factor SF-2 of the toner is $100<SF\text{-}2\leqq 140$, and a ratio of the shape factor SF-2 to the shape factor SF-1, SF-2/SF-1, is 0.63 or more and 1.00 or less.

3. The image forming method according to claim 1, wherein the toner has a maximum endothermic peak in a temperature range of from 65° C. to 105° C. in measurement of melting points by DSC.

4. The image forming method according to claim 1, wherein the openings of all the depressed portions have an average minor-axis diameter Lpc satisfying the following expression (2):

$$Dg<Lpc<Dt-\sigma \quad (2)$$

where Dt-σ represents a value found by subtracting standard deviation of particle size distribution of the toner from Dt.

5. The image forming method according to claim 1, wherein all the depressed portions each have a shape satisfying the following expression (3):

$$(1/2)\times Rdv\times Rpc<Sdv<Rdv\times Rpc \quad (3)$$

where Rdv represents a depth of the depressed portion; Rpc represents a major-axis diameter of an opening of the depressed portion; and Sdv represents an area of a cross section of the depressed portion that includes the major-axis diameter of the opening of the depressed portion and is perpendicular to a rotational axis of the photosensitive member.

6. The image forming method according to claim 1, wherein all the depressed portions each have a shape of a dimple composed of a continuous curved surface having no clear boundary between the dimple and a non-depressed portion.

7. The image forming method according to claim 1, wherein all the depressed portions have been formed by laser abrasion processing.

8. The image forming method according to claim 7, wherein laser light used in the laser abrasion processing has a oscillation pulse width of 1 ps or more and 100 ns or less.

9. The image forming method according to claim 1, wherein all the depressed portions have been formed by pressing a mold having on its surface an unevenness profile.

10. The image forming method according to claim 9, wherein the surface of the photosensitive member has a modulus of elastic deformation of 40% or more and 65% or less.

11. The image forming method according to claim 1, wherein a shape of each toner particle and a shape of each depressed portion on the surface satisfy the following expression (4):

$$C\geqq -0.0241\times \mathrm{Log}(\tan^{-1}((Epc-Epch)/Edv)/Epc)+0.917 \quad (4)$$

where;

Epc represents a longest diameter in a photosensitive member peripheral direction of an opening of each independent depressed portion;

Edv represents a maximum depth of a cross section of the depressed portion that includes the longest diameter and is perpendicular to a rotational axis of the photosensitive member;

Epch represents a diameter in the photosensitive member peripheral direction of the depressed portion at a depth of half the maximum depth; and C represents the average circularity of the toner.

12. The image forming method according to claim 1, wherein powder remaining on the photosensitive member is removed by cleaning by means of a cleaning unit having a cleaning blade.

13. An electrophotographic apparatus which comprises a photosensitive member, a charging means, an exposure means, a developing means, a transfer means and a cleaning means, and uses the image forming method according to claim 1 to reproduce an image.

* * * * *